US006338682B1

(12) United States Patent
Torchia et al.

(10) Patent No.: US 6,338,682 B1
(45) Date of Patent: Jan. 15, 2002

(54) PORTABLE, ADJUSTABLE-CONTOUR, PUTTING GREEN

(75) Inventors: H. Andrew Torchia, Barrington Hills, IL (US); Todd R. Mendenhall, Riverton, UT (US); Frank M. Rowe, Bensenville, IL (US)

(73) Assignee: PuttGolf.com, LLC, Rosemont, IL (US)

( * ) Notice: Subject to any disclaimer, the term of this patent is extended or adjusted under 35 U.S.C. 154(b) by 0 days.

(21) Appl. No.: 09/497,386

(22) Filed: Feb. 3, 2000

Related U.S. Application Data

(60) Provisional application No. 60/156,041, filed on Sep. 24, 1999.

(51) Int. Cl.[7] ..... A63B 69/36
(52) U.S. Cl. ..... 473/160
(58) Field of Search ..... 473/160, 161, 473/157–159, 162–166, 171, 181

(56) References Cited

U.S. PATENT DOCUMENTS

| | | | | | |
|---|---|---|---|---|---|
| 2,678,823 | A | | 5/1954 | Hugman | 273/35 |
| 3,522,947 | A | * | 8/1970 | Anderson et al. | 473/161 |
| 3,595,581 | A | * | 7/1971 | Anderson | 473/161 |
| 3,601,407 | A | * | 8/1971 | Lorrance | 473/160 |
| 3,690,673 | A | | 9/1972 | Occhipinti | 273/176 H |
| 3,892,412 | A | | 7/1975 | Koo | 273/176 H |
| 4,211,417 | A | | 7/1980 | Brown | 273/176 H |
| 4,240,637 | A | | 12/1980 | Cross et al. | 273/176 H |
| 4,247,112 | A | | 1/1981 | Del Raso | 273/176 H |
| 4,790,538 | A | * | 12/1988 | Gettelfinger | 473/161 |
| 4,978,127 | A | | 12/1990 | Juel, Jr. | 273/176 H |
| 4,988,106 | A | * | 1/1991 | Coonrod | 473/160 |
| 5,002,280 | A | | 3/1991 | Hines | 273/176 FB |
| 5,087,045 | A | | 2/1992 | Kim | 273/176 H |
| 5,301,947 | A | | 4/1994 | Kim | 273/176 H |
| 5,318,303 | A | | 6/1994 | Kim | 273/176 H |
| 5,441,265 | A | | 8/1995 | Codlin | 273/176 H |
| 5,655,971 | A | | 8/1997 | Wayne | 473/160 |
| 5,733,200 | A | | 3/1998 | Kim | 473/161 |
| 5,855,522 | A | | 1/1999 | Bevan | 473/160 |
| 5,863,256 | A | | 1/1999 | MacLean et al. | 473/160 |
| D418,891 | S | | 1/2000 | Sirak | D21/791 |
| 6,050,901 | A | * | 4/2000 | Davis | 473/160 |

OTHER PUBLICATIONS

"Electronic Putting Challenge", GL Technology, Inc. Brochure, 1998.
"Big Moss Putting Greens", Big Moss Catalog page.
"Dream Green", Dream Green, Jan. 1, 1998.
"Putt'N Hazard", The Sharper Image Catalog Page, p. 34.
"Executive Putting Trainer" Catalog Page, May 99.
"Putting Game",www.golfsmith.com, Catalog page, Nov. 1999, p. 53.
Pro Putting Mat, Match Play, Inc. Brochure.

* cited by examiner

*Primary Examiner*—Mark S. Graham
(74) *Attorney, Agent, or Firm*—Pate Pierce & Baird

(57) ABSTRACT

An artificial putting green provides an architected green lie adjustable by a user in accordance with the true contouring elements available on a real golfing green. A user actually stands on the green itself, and may position himself or herself above or below the cup with an intervening swell or rise between the user and a cup. A break to the left or the right may be provided between the cup and the deck. The deck may actually be canted from side to side. Moreover, the deck may be elevated front to back or back to front. Accordingly, by independent adjustment of multiple feet, the deck may be a proper part of the green as will be encountered in actual practice on a real green. Multiple contours from left-to-right and right-to-left may be adjusted in the intervening distance between a user and the cup.

29 Claims, 17 Drawing Sheets

PORTABLE, ADJUSTABLE-CONTOUR, PUTTING GREEN

RELATED APPLICATIONS

This application claims the benefit of earlier-filed U.S. patent application Ser. No. 60/156,041, filed Sep. 24, 1999, for "Portable, Adjustable-Contour Golfing Green," which is incorporated herein by reference.

BACKGROUND

1. The Field of the Invention

This invention relates to sporting goods, and, more particularly, to novel systems and methods for golf practice green construction and use.

2. The Background Art

Golf has enjoyed popularity over centuries. New players, at an increasing rate, devote leisure time to improving skills in the game at an increasing rate. Although the game of skill at directing a ball is simple in principle, numerous factors affect one'stability to repeatably strike a ball correctly. A major portion of golf is the putt. One third to one half the strokes representing a player's score may often be putting strokes.

Accordingly, a never-ending desire to improve the game, and an eternal belief that one can improve, motivate individuals to practice. The expense and availability, as well as the inconvenience, of practicing on actual courses limit practice. Improved driving requires space. Improved putting requires not space but true conditions reflecting actual putts. Numerous devices exist to facilitate a user putting a ball in an artificial environment. However, prior art systems failed to produce the effective practice due to the inaccurate conditions of replication of actual golf putting.

One difficulty of golfers is obtaining a natural lie in an artificial environment. Putting practice in a back yard of a home does not provide natural conditions of a green. A green is typically provided with sand as the uppermost soil layer, with a specific type and density of grass at a specific height to provide the desired stimp. The actual variations might be something less than infinite, but a large number, as a practical matter. Contours may vary in a longitudinal direction between a golfer and a cup, and in a lateral direction side-to-side across the travel path of the ball.

Indoor systems or portable systems may rely on conventional carpets of a room, or specialized carpets for taking the place of a green surface. Both suffer, albeit unequally, from the inability to provide the compression, the fiber resistance, the stiffness of the fibers, the length of fibers, and other conditions of the natural green.

Simple systems that enjoy light weight provide crude replication of putting conditions. More complex systems are not portable, not readily adjustable or both. Slopes in a longitudinal direction and, at the same time, in lateral a direction that represent the true conditions of a golfing green are important, even necessary, and unavailable.

Typical systems provide a raised area around the cup for returning a ball that misses the cup. Such a geometry is very unlike an actual green. Various attempts to gradually change contours surrounding a cup provide complex, cumbersome, heavy, expensive, and still inadequate structures. Certain attempts have positioned frames above and beside a green. Such visual obstacles are very unlike a green, and provide several disadvantages and irregularities. For example, an actual green provides only certain unique sensations of space, angle, and the like. Artificial structures provide references for determining distances and positions. Moreover, visual obstructions distract.

Carpets placed on a floor typically provide both inadequate compression, fiber activity, and contours, while unable to provide any downhill lie toward the cup, and, typically, any repeatability in contouring mechanisms. Systems relying on more framing than structure beneath a carpet are typically either too rigid or too soft, the first being too heavy, and the second being mechanically inadequate for representing the actual performance for a golf green.

Golfers are forever hopeful of improving their game. To this extent, commercial putting greens, miniature golf, and driving ranges proliferate. However, most putting green practice areas do not represent greens on actual golf courses. Using leveling and "unleveling" equipment, greens constructors grade the surface of a green to provide hills and hollows along the surface of the green moving from the perimeter thereof toward the cup.

As a result, the contours encountered by a ball traveling in a more-or-less direct line along the green toward a cup are anything but a direct line. A ball may be rolled to one side, another, or both on its path toward the cup. However, conventional artificial golfing greens, office carpets, and the like do not provide an ability to replicate the lateral contours or vertical variations along longitudinal lateral lines orthogonal to the putting direction between a putting club and the golf cup on a golfing green.

What is needed is a structure and method replicating true contours, feel, appearance, action, lie, and positioning in a lightweight, portable economical artificial putting system.

BRIEF SUMMARY AND OBJECTS OF THE INVENTION

In view of the foregoing, it is a primary object of the present invention to provide a practice green that provides adjustable contours, including multiple adjustable contours, that may be changed in vertical elevation, provide different vertical elevations at opposing ends of a laterally placed line across the practice green, and provide multiple instances of variable contour lines laterally extending lines) along a longitudinal trajectory between a golf ball and the cup of a putting green.

Consistent with the foregoing objects, and in accordance with the invention as embodied and broadly described herein, an apparatus and method are disclosed, in suitable detail to enable one of ordinary skill in the art to make and use the invention. In certain embodiments an apparatus and method in accordance with the present invention may include a mat having a "green" layer on top and a structural member or tension layer below, separated by an intermediate web or spacing pad. Stringers (flexible longitudinal rods) may provide continuity or smoothing of the longitudinal variations in height along the green. Cross members may provide elevation changes along the longitudinal direction or access a lateral direction of the green.

Feet on each of the cross members may be independently adjustable to provide a "cant" from one side to the other, or vice versa, at any contour along the longitudinal direction. A pedestal or deck may be provided for a user. The user may adjust the height of the deck arbitrarily in order to be below, above, or level with the cup. Intermediate the deck and the cup, the contours may be adjusted individually, and on each side to create breaks right or left, rising or descending slopes to the cup, and multiple combinations thereof.

BRIEF DESCRIPTION OF THE DRAWINGS

The foregoing and other objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF THE PREFERRED EMBODIMENTS

Figure 1:
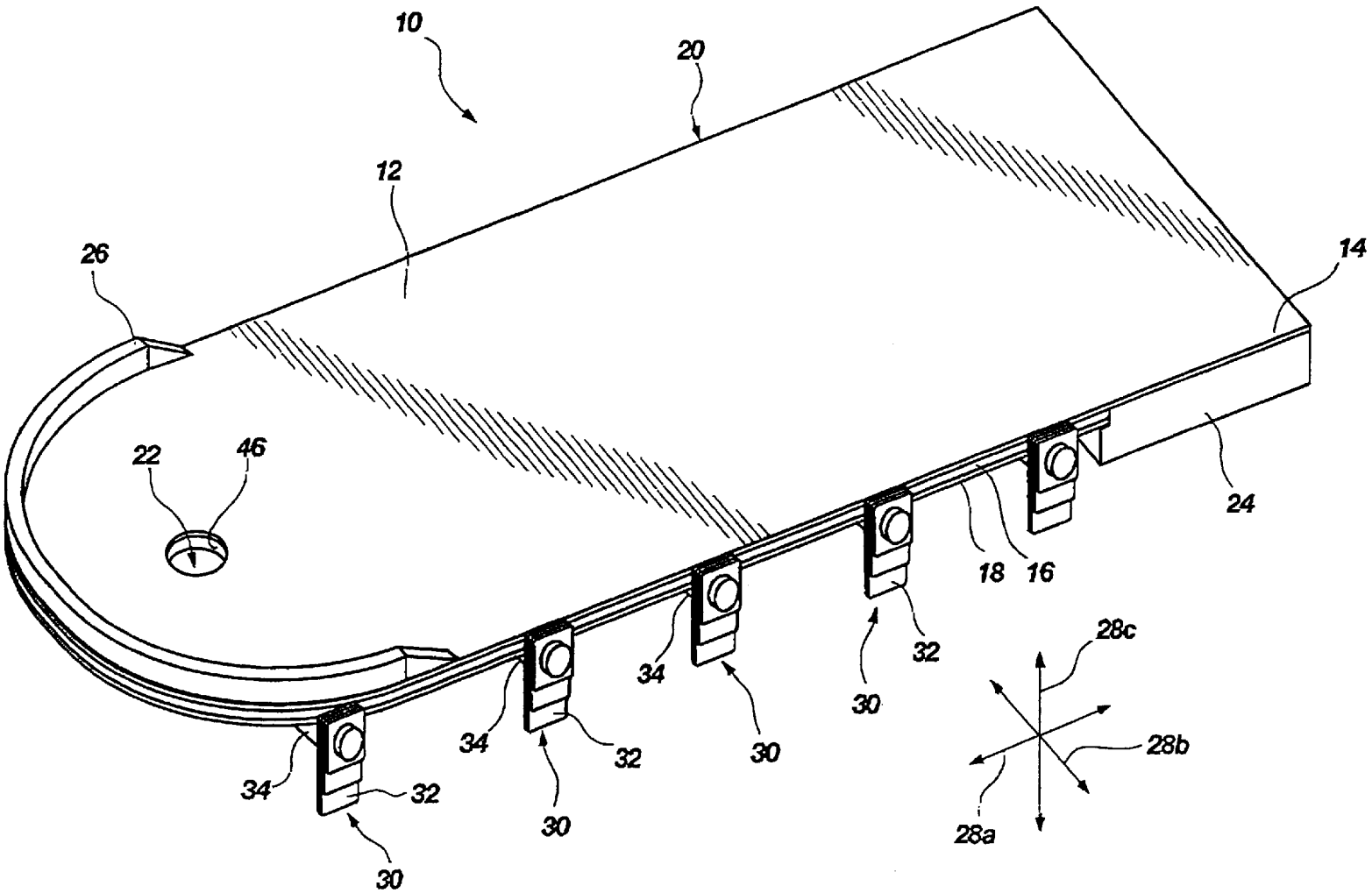
FIG. 1 is a perspective view of an apparatus in accordance with the invention.
Figure 2:
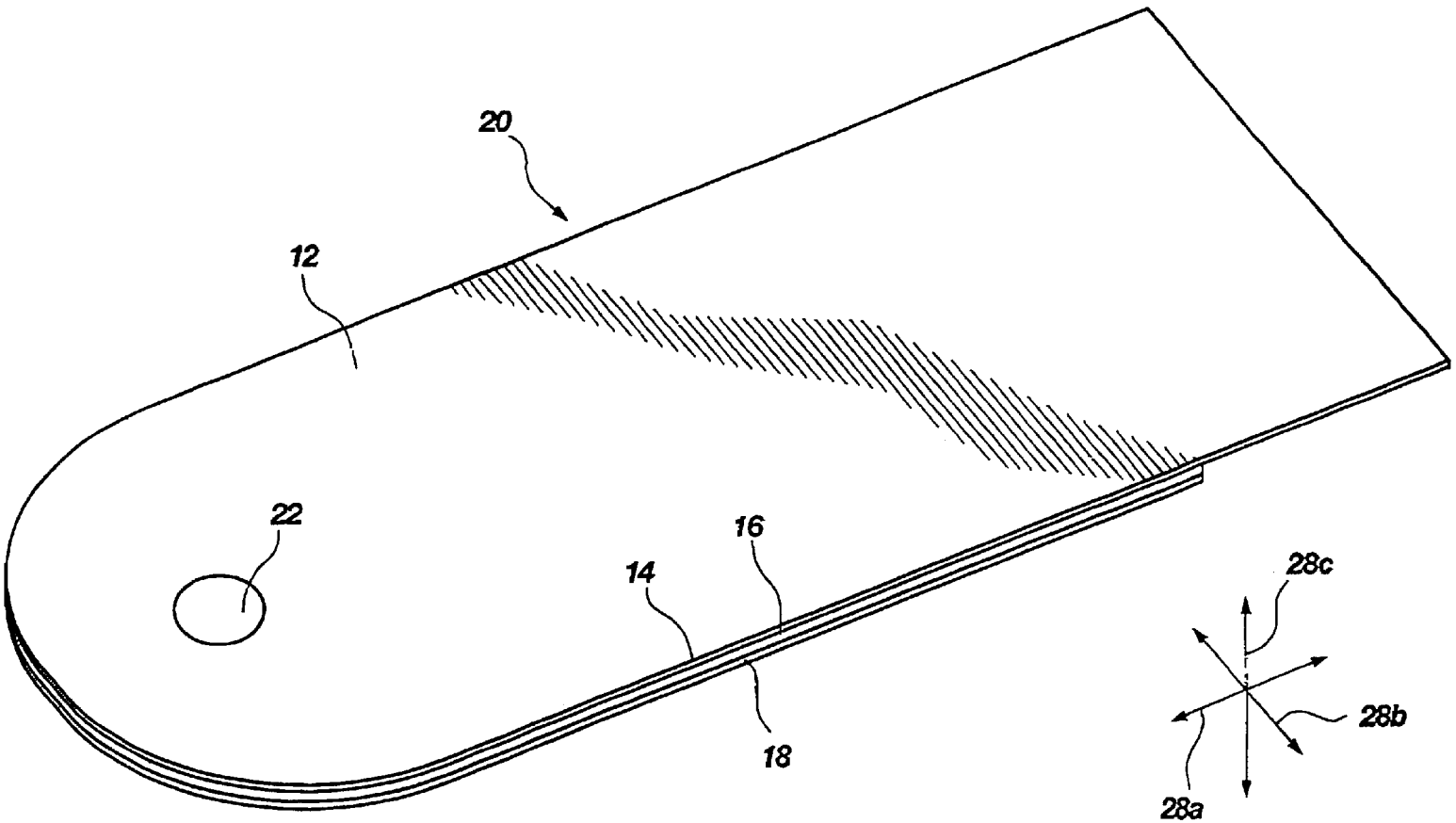
FIG. 2 is a perspective view of the mat portion of the apparatus in FIG. 1.
Figure 3:
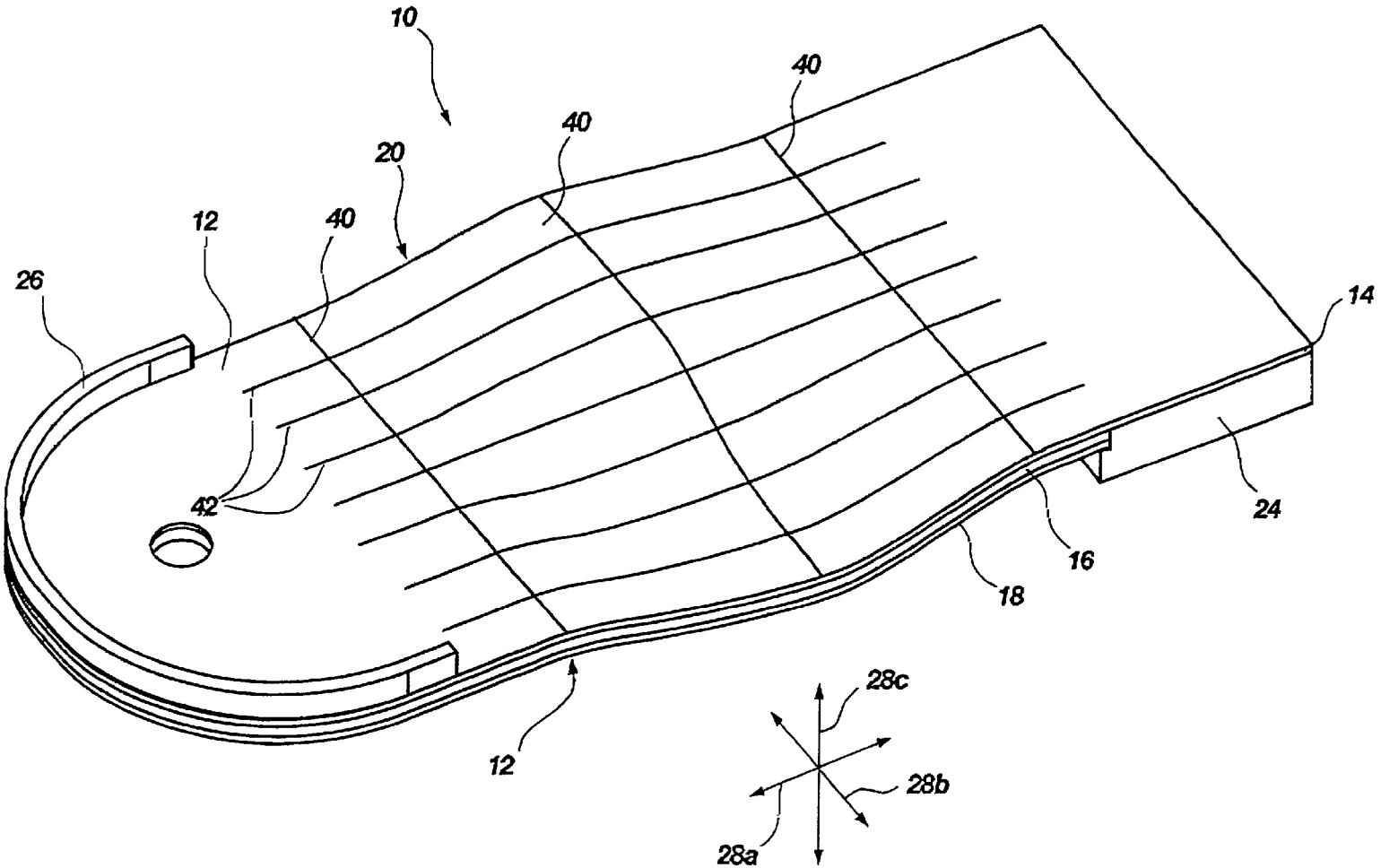
FIG. 3 is a perspective view of one embodiment of the mat of FIG. 2 illustrating one variation of contours.

It will be readily understood that the components of the present invention, as generally described and illustrated in the Figures herein, could be arranged and designed in a wide variety of different configurations. Thus, the following more detailed description of the embodiments of the system and method of the present invention, as represented in FIGS. 1 through 14, is not intended to limit the scope of the invention. The scope of the invention is as broad as claimed herein. The illustrations are merely representative of certain, presently preferred embodiments of the invention. Those presently preferred embodiments of the invention will be best understood by reference to the drawings, wherein like parts are designated by like numerals throughout.

Those of ordinary skill in the art will, of course, appreciate that various modifications to the details of the Figures may easily be made without departing from the essential characteristics of the invention. Thus, the following description of the Figures is intended only by way of example, and simply illustrates certain presently preferred embodiments consistent with the invention as claimed.

The present invention may be embodied in other specific forms without departing from its structures, methods, or other essential characteristics as broadly described herein and claimed hereinafter. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

Referring to FIG. 1, and FIGS. 1–21, generally, an apparatus 10 may have a surface 12 suitably configured to provide the texture of a golf green. The surface 12 may be supported as an upper surface 12 of a green layer 14. That is, the green layer 14 may be carpet, mat, or some artificial material that provides the appropriate roughness, flexibility, stiffness, and the like to provide a desired stimp value that may be encountered on an actual golf green.

Below the green layer 14 a stiffener 16 or a filler layer 16 provides spacing and mechanical stiffness yet localized deflection. That is, the section modulus of the apparatus 10 or pad 20 may benefit from having a web 16 or filler 16 below the green layer 14. Thus, the surface 12 may undulate more smoothly and appropriately, rather than providing localized areas of excessive flexibility, or discontinuities of curvature.

In one embodiment, a tension layer 18 may be positioned, secured, set, or bonded to the filler layer 16. The layer 18 may be fabric, plastic, cardboard, or the like, in various embodiments. It may be continuous or sectional. Thus, a "sandwich" of the green layer 14, and tension layer 18 capturing the filler layer 16 therebetween forms a mat 20. The mat 20 forms the upper part of the apparatus 10 or artificial green 10.

A user may stand at a height (vertical displacement) different from that of a cup 22 associated with a green surface 12. The surface 12 under user may be higher, lower, or even with the surface 12 at the cup 22. Accordingly, a deck 24 may underlie the mat 20. In selected embodiments, the deck 24 may actually replace the filler layer 16 and tension layer 18 under the green layer 14 in the area of the deck 24. Fasteners may connect the green layer 14 to the deck 24, while other members 46 push the cup region of the layer 14 away in tension.

In certain embodiments, a backstop 26 may stop a ball that misses the cup 22 in practice. Absorbing energy, the backstop may bring a ball to a rest, rather than returning it. Likewise, the backstop 26 may otherwise provide a natural or unnatural mechanism for stopping an overshoot in a confined space.

In general, the green may have directions 28*a,* 28*b,* 28*c.* The directions 28 correspond to a longitudinal direction 28*a,* with respect to the apparatus 10, a lateral direction 28*b* across the apparatus 10, and a transverse direction 28*c* that is substantially vertical for practical purposes. In certain preferred embodiments of an apparatus 10 in accordance with the invention, a ball is stroked, struck, or otherwise urged (by a standing user) in a longitudinal direction 28*a* from the surface of the green layer 14 above the deck 24 toward the cup 22. Adjustment of the elevators 30 in the transverse direction 28*c* provides contours urging the ball to break (drift) in a lateral direction 28*b* as a result.

The elevators 30 may include multiple feet 32. In certain embodiments, the elevators 30 may be closer or farther apart in a longitudinal direction 28*a*. In one embodiment, the feet 32 of the elevators 30 may actually be a stack 30 of multiple feet 32. In order to accommodate the lowest elevation 28*c* for the green layer 14, or more properly, the green surface 12, the feet 32 may be turned to provide a nominal elevation. In other embodiments, a selected foot 32 may be rotated centrically or eccentrically (see FIG. 5) about a cross beam 34 to provide additional variations of height at any particular location of a foot 32. Thus, every foot 32 may be independently positionable.

In certain alternate embodiments, the cross beams 34 may have feet 32 permanently attached. For example, a hexagonal foot 32 attached to one end of a cross beam 34 in an eccentric manner may be simply rotated like about the longitudinal axis of the cross beam 34 to provide a change in height. However, for compactness, portability, and the like, multiple feet 32, having various distinct heights 25*a,* but a common width 25*b,* and a common thickness 25*c,* may provide superior performance. In one presently preferred embodiment, the feet 32 may be formed of a durable, flexible plastic (e.g. polyethylene, other olefinics, polycarbonate, etc.) To bend in case of a user accidentally stepping off the and onto the green surface 12. In reality, the green feels so real that users forget, and step toward the cup 22.

Fasteners 36 may connect the feet 32 to the respective cross beams 34. Likewise, fasteners or clamps 36 may connect the cross beams 34 to the mat 20.

As a practical matter, contours 40 are side-to-side elevation changes. Meanwhile, the contours 42 are end-to-end elevation changes. Rotating the proper foot 32 into position at the end of a cross beam 34 provides a distinct elevation for any particular contour 40 desired. An adjustment of a foot 32 to provide a particular contour 40 will also effect a contour 42. However, contours 42 are created by placing the feet 32 of adjacent cross beams 34 at different elevations. The contours 40 are created by positioning feet 32 of a shared cross beam 34 at different elevations 28*c*.

Figure 4:
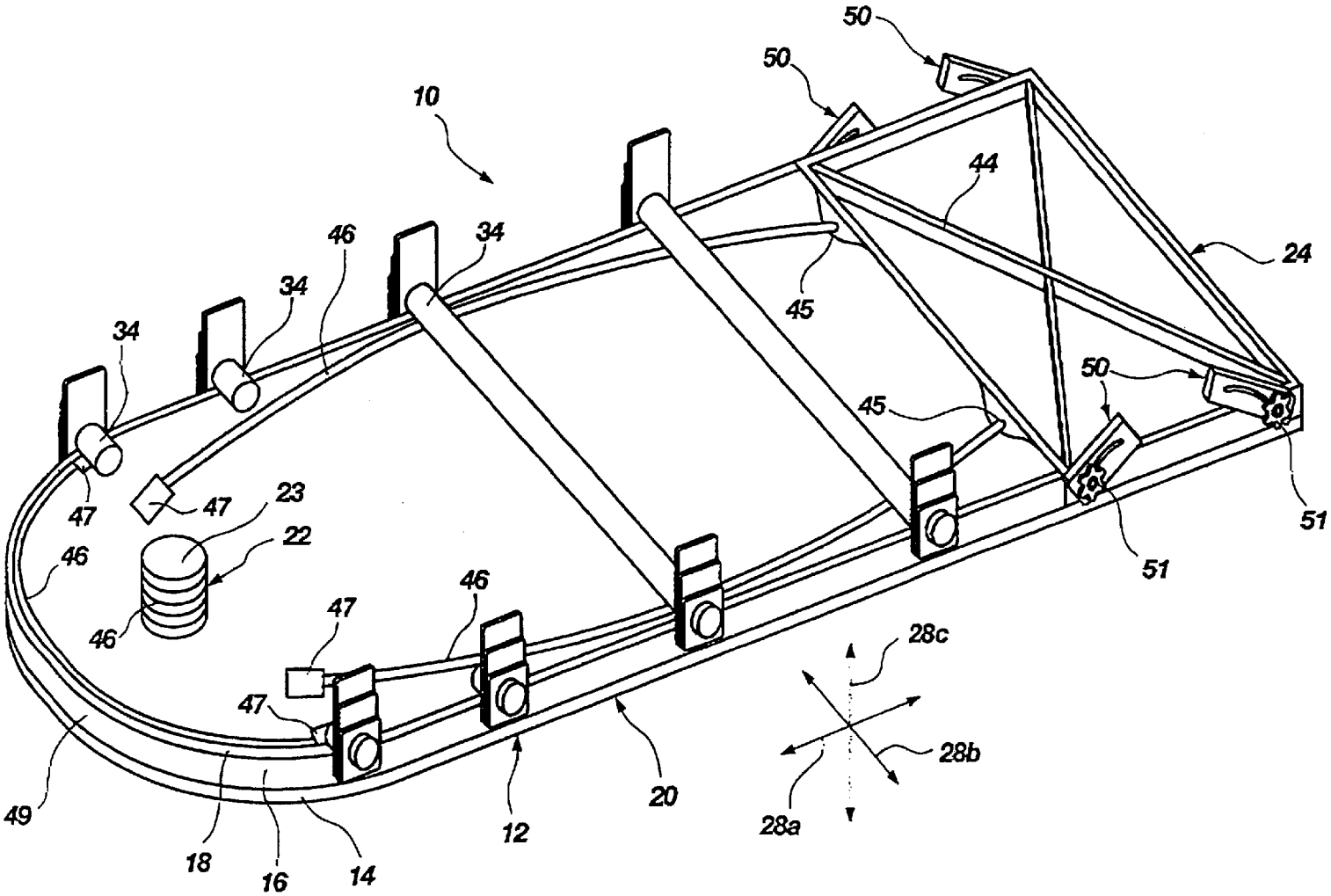
FIG. 4 is a perspective view of the underside of the apparatus of FIG. 1.

Referring to FIG. 4, while continuing to refer generally to FIGS. 1–21, reinforcement webs 44 may be provided in order to render the deck 24 lighter and stronger. In certain embodiments, reinforcement webs 44 may be fabricated, molded or otherwise manufactured by any suitable method in order to provide the proper strength, weight, stiffness, and other mechanical properties required for the deck 24 to support a user thereon.

A flexible wall 46 of the cup 22 may be desirable. A small change in volume at one end of the mat 20 may provide for a considerably reduced overall size when the mat 20 is rolled up. Also, the weight of one or more golf balls in the cup 22 may distort or the green layer 14 nearby. Thus, in certain embodiments, a flexible wall 46 may be provided in the cup 22, 20 such that the cup 22 will extend or rest on an underlying surface. The flexible wall 46 allows the cup 22 to collapse virtually completely within the rolled up mat 20, or conform closely to the mat 20, when stored.

In certain embodiments, stringers 48 (spring-loaded or flexible rods) may provide flexible, yet somewhat stiff members. Actually, the stringers 48 may be designed to have a balance of flexibility and stiffness. Accordingly, the stringers 48 may pass over or through the cross beams 34 in such a manner as to support the mat 20 between the cross beams 34, or, more properly, between adjacent cross beams 34. Nevertheless, the stringers 48 are also flexible enough to move up and down over the cross beams 34 in order to provide the smoothly undulating change in elevation in the longitudinal 28*a* and transverse direction 28*c* to make contours 42.

In one embodiment, stringers 48 may extend along the longitudinal direction 28*a*. Also, at least one of the stringers 48 may be restrained in an arcuate form in order to support the edges 49 of the green mat 20. In alternate embodiments, the stringers may extend conformally along the mat 20 more-or-less all parallel (see FIG. 16).

The deck 24 may have adjustable swing arms 50. Thus, the elevation of the deck 24 in the transverse direction 28*c* (approximately a vertical direction 28*c* for a horizontal mat 20) may be adjusted by the swing arms 50. Typically, the swing arm 50 may be adjusted to make a level or untilted deck 24. However, such is not required. The deck 24 may be raised, lowered, and canted in any direction, the stringers 48 maintaining continuity of position (deflection) and first and second derivatives thereof in a longitudinal direction 28*a* along the mat 20.

Figure 5:
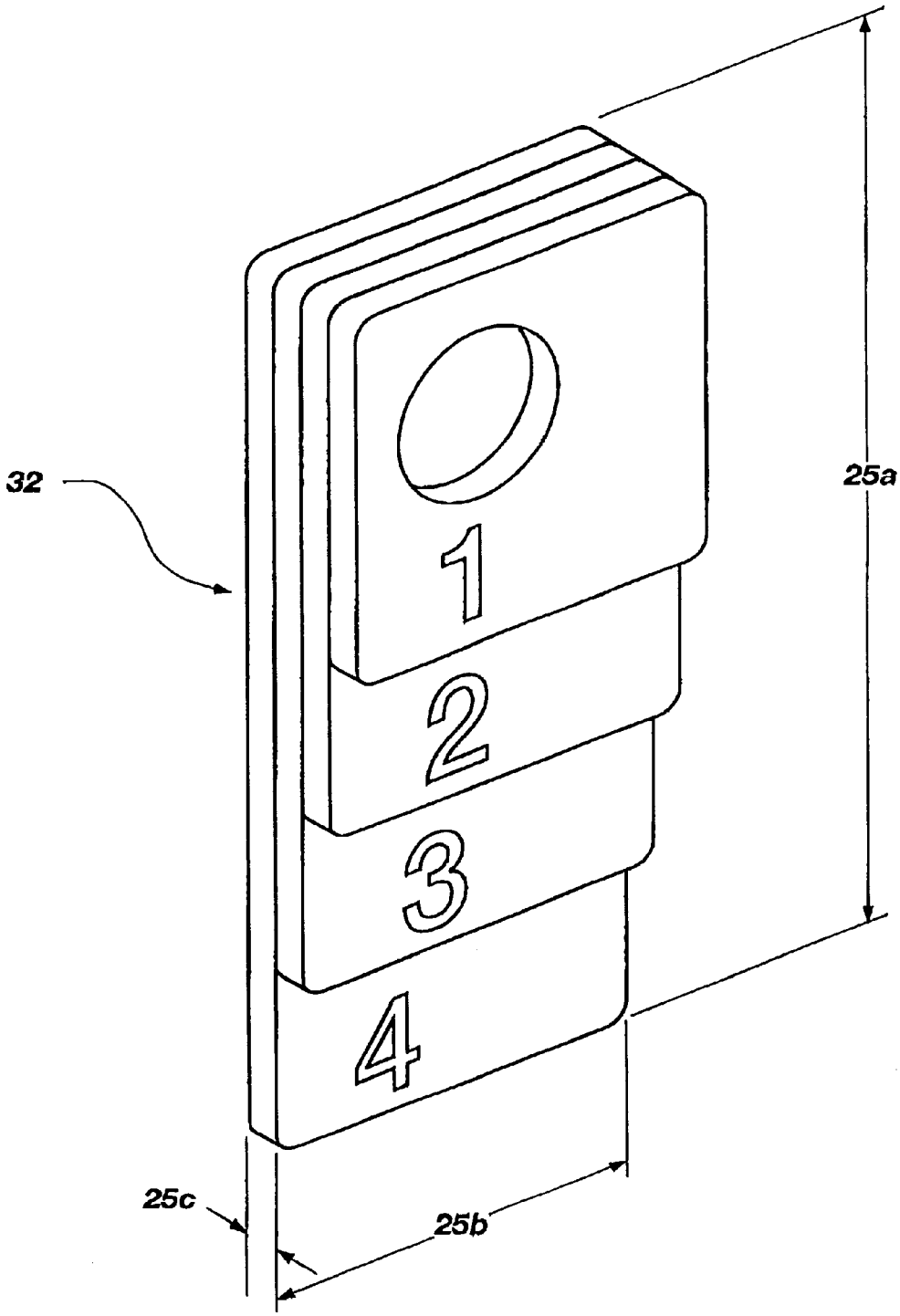
FIG. 5 is a perspective view of feet suitable for supporting the cross members in the apparatus of FIGS. 1–4.
Figure 6:
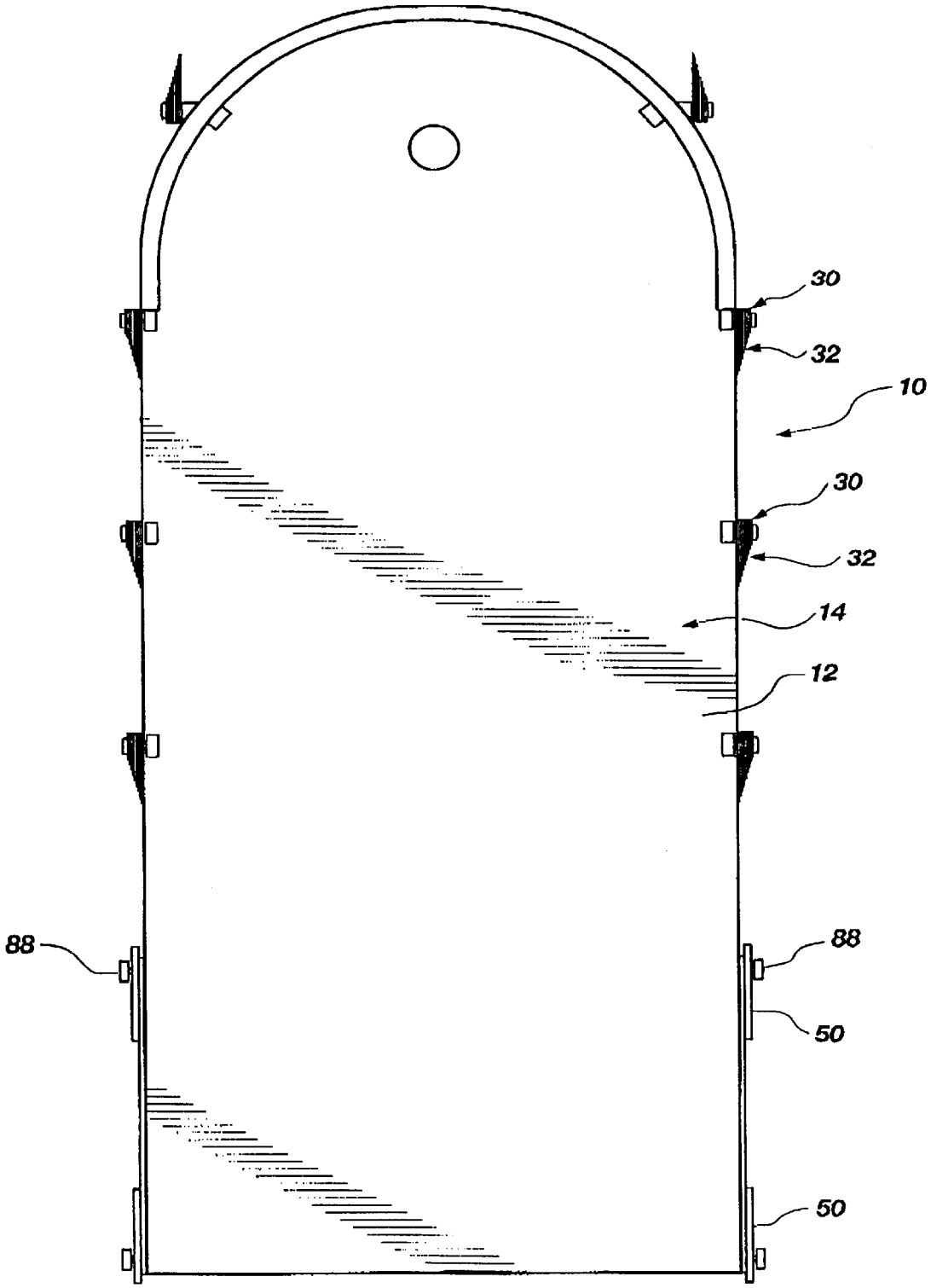
FIG. 6 is a top plan view of the apparatus of FIG. 1.
Figure 7:
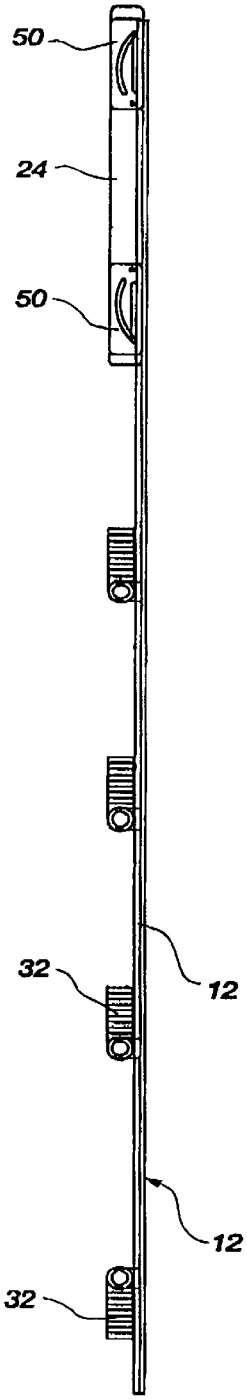
FIG. 7 is a side elevation view of the apparatus of FIG. 1.
Figure 8:
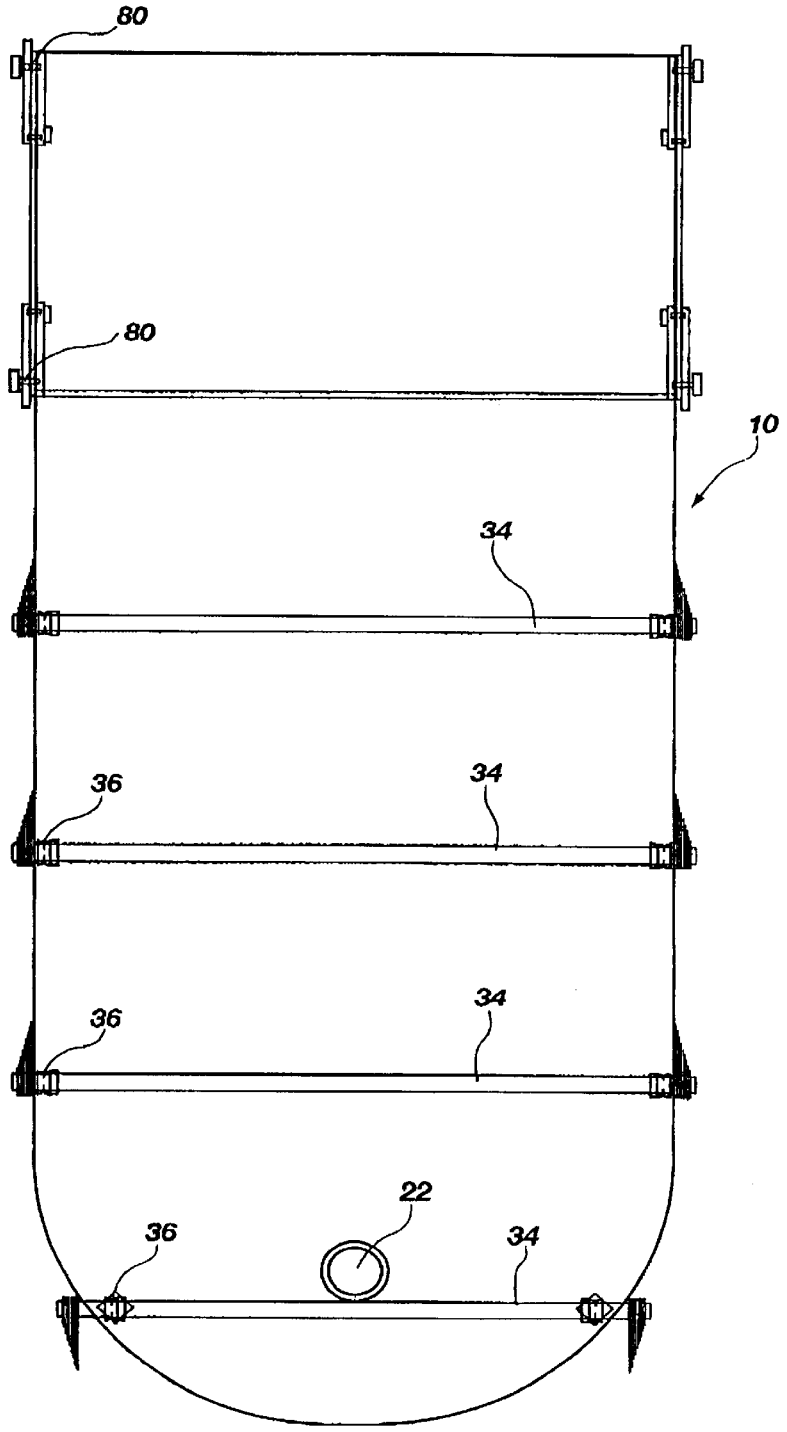
FIG. 8 is a bottom plan view of the apparatus of FIG. 1.
Figure 9:
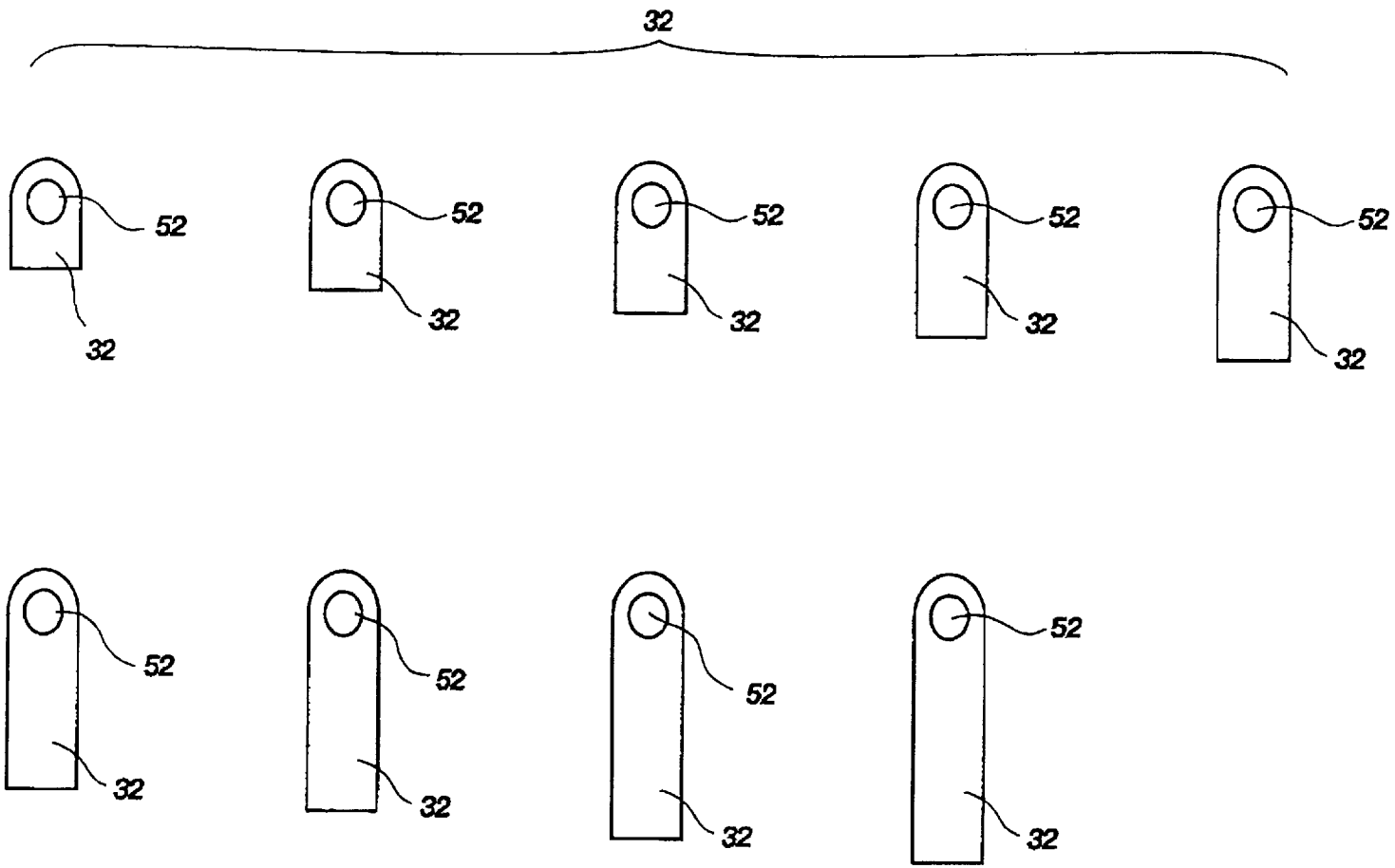
FIG. 9 is a side elevation view of the individual feet of a foot assembly of the apparatus of FIG. 1.
Figure 19:
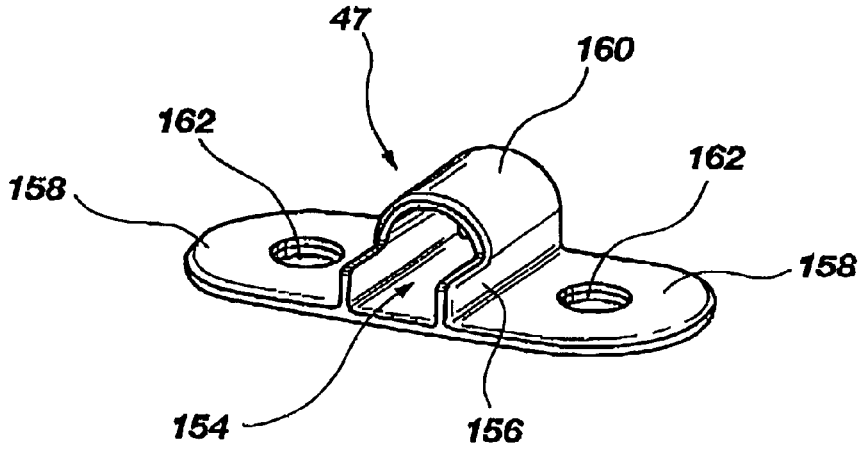
FIG. 19 is a perspective view of one embodiment of a pocket for receiving an end of a stringer of FIG. 16.
Figure 20:
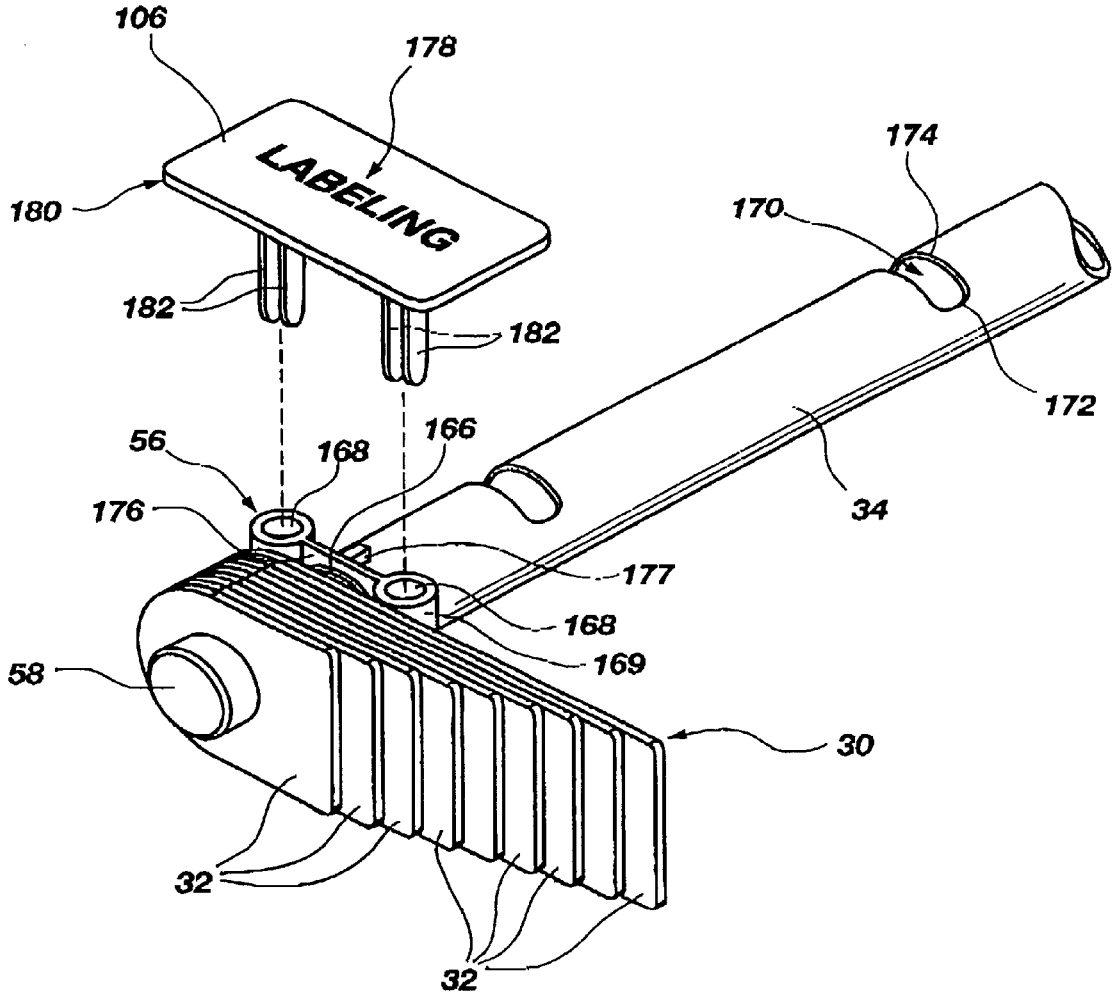
FIG. 20 is a perspective view of a portion of a cross-beam, fitted with adjustable legs and a labeled fastener in one embodiment of an apparatus of FIGS. 15–17.

Referring to FIG. 9, while also referring to FIGS. 5 and 20, specifically, and FIGS. 1–21, generally, feet 32 may be provided in various lengths. The feet 32 may be provided with an aperture 52 that fits around the cross beam 34. Each of the apertures 52 may receive a cross beam 34, and suitable fasteners 36 may retain the assembly of feet 32 at one end of a cross beam 34. Likewise, a clamp or fastener 36 may attach the mat 20 to a cross beam 34. The cross beams 34 may be tubular, or solid rods. The cross section of a cross beam 34 may be rectangular or cylindrical. In one presently preferred embodiment, the cross beam 34 may be a right circular cylinder. Meanwhile, a restraint 56 and cap 58 may provide a an attachment for the feet 32, securing the feet 32 in a lateral direction 28 along the cross beam 34.

Referring to FIGS. 10–14, while continuing to refer generally to FIGS. 1–21, a foot 70, adjustable foot assembly, or simply an adjuster 70 may be secured to the deck 24. In one embodiment, a race arm 72 provides a fixed member with respect to the deck 24. A race arm 72 (an arm 72, having a race 76 therein) may be fixedly mounted at an appropriate position on the deck 24. Meanwhile, a swing arm 50 may connect about a pivot 75 to the race arm 72. The swing arm 50, in contrast to the race arm 72, rotates about the pivot 75 in order to extend away from the deck 24.

The race 76 or aperture 76 in the race arm 72 may describe an arcuate path. Actually, the path of the aperture 76 or race 76 is designed to produce an intersection with an aperture 78 provided in the swing arm 50, such that movement of spindle 80 along aperture 76 is proportional to the vertical distance of the swing arm 50 below the deck 24. The path of the aperture 78, in one embodiment, may be straight. Nevertheless, the paths of each of the apertures 76, 78 may be designed to provide a particular performance in the locking of the swing arm 50 with respect to the race arm 72 in order to adjust the adjustable foot assembly 50.

In one embodiment, a spindle 80 or axle 80 extends through both apertures 76 and 78. Without a load (e.g., weight) applied to the swing arm 50, the spindle 80 may be moved easily along the apertures 76, 78 to some suitable point. The swing arm 50 may be left loose to be easily moved when unloaded, yet to bind against the axle 80.

The swing arm 50 will be extended to a particular height 82 or displacement 82 beyond the neutral or beginning position. Accordingly, the swing arm 50 may actually engage a supporting surface 84 with a portion 86 such as a corner 86. In one presently preferred embodiment, the corner 86 may be configured as a smoothly radiused vertex of edges of the swing arm 50. Accordingly, the swing arm 50 may easily contact the surface 84 at any position dictated by the position of the spindle 80.

The spindle 80 may also be adjusted and locked by any suitable mechanism. For example, a thumb screw or knurled-head nut may be threaded onto the spindle 80 in order to clamp the swing arm 50 and race arm 72 together. Nevertheless, in certain embodiments, the binding force provided by angle of intersection of the arcuate aperture 76 and the straight aperture 78 is sufficient to hold the spindle 80 in any position to which it is moved without load. Thus, once load is applied, the spindle 80 binds, simply remaining even more thoroughly fixed in its position with respect to the arms 72, 50.

Referring to FIGS. 11–14, while also referring to FIGS. 1–21 generally, the swing arm 50 and the race arm 72 may be formed of any suitable material. For example, the arms 72, 50 may be formed of a durable plastic. In certain embodiments, machined aluminum has proven effective. Nevertheless, any material suitable for the structural requirements and the leverage advantage provided by the spindle 80 may be used.

Referring to FIGS. 11–14, a race arm 72 may include an aperture 76 for passing a connector 80 (e.g. a bolt, axle, rivet, pin, etc.) therethrough. A race 73 provides a shoulder for capturing a square head or the like of a retainer end on the connector 80 in order to slidably move the retainer and connector 80 (e.g. a bolt, etc.) along the aperture 76.

In selected embodiments, a round-headed bolt 80 having a completely rectangular shank may serve adequately. In some embodiments, a rectangular head has been found superior, especially if sufficient bearing surface thereon adequately stabilizes the bolt normal (substantially perpendicular) to the outer surface 71 of the race arm 72.

Apertures 77 for receiving fasteners (e.g. rivets, bolts, cap screws, machine screw, etc.) may be aligned to fit corresponding apertures and receiving assemblies in the deck 24. Thus, the race arms 72 may attach securely to the deck 24.

The swing arm 50 includes an aperture 78 for receiving a retainer therethrough. The retainer, passing perpendicular to the surfaces 71 of the swing arm 50 and the race arm 72 may be captured in the race 73 by the head, and by a corresponding adjuster 51, (e.g. knob 51) at an opposite end. Between the ends, the fastener or retainer may extend through the arms 72, 50 to apply compression therebetween. Nevertheless, the geometry of the apertures 76,78 in the respective arms 72, 50 is shaped to provide binding through a designed application of force therebetween.

Figure 10:
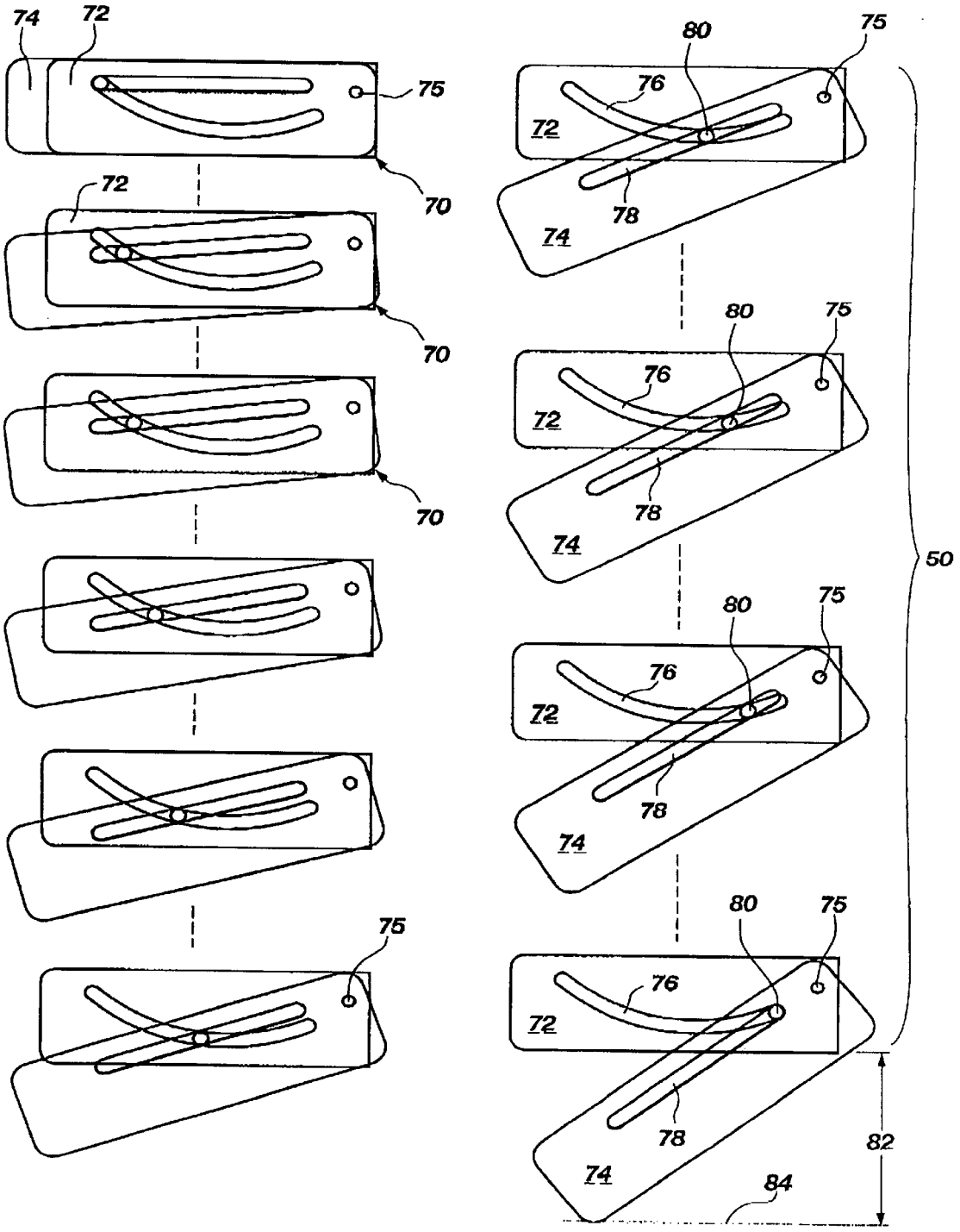
FIG. 10 is a side elevation view of the deck-supporting foot assembly for the apparatus of FIG. 1.
Figure 11:
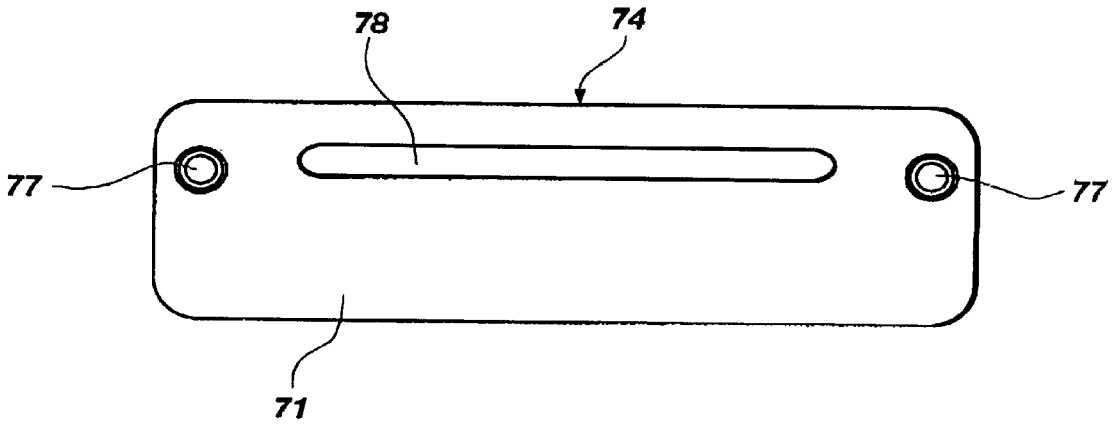
FIG. 11 is a side elevation view of one embodiment of a race arm portion of the apparatus of FIG. 10.
Figure 12:
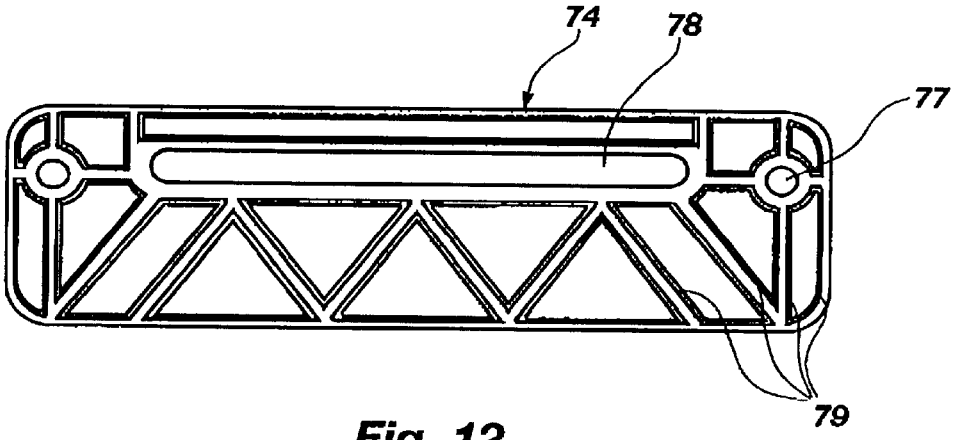
FIG. 12 is a side elevation view of the race arm of FIG. 11.
Figure 13:
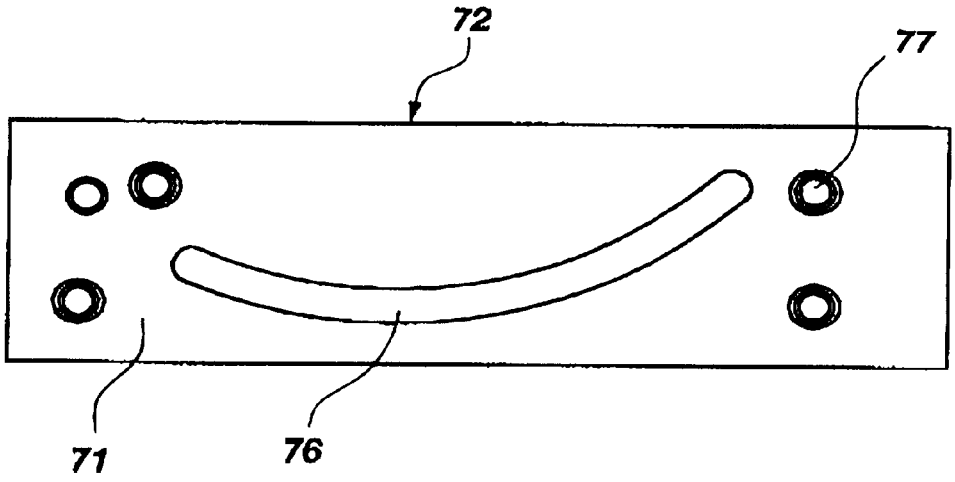
FIG. 13 is a side elevation view of one embodiment of a swing arm of the apparatus of FIG. 10.
Figure 14:
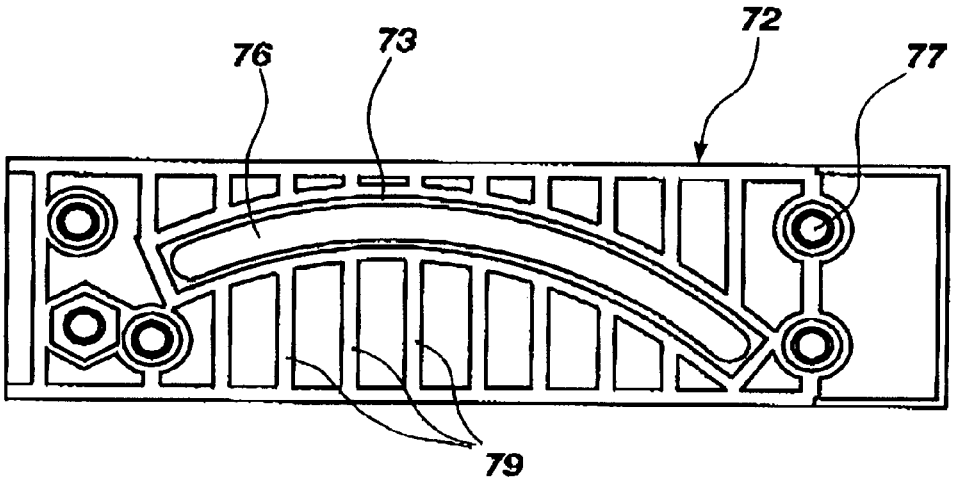
FIG. 14 is a side elevation view of the swing arm of FIG. 13.

FIG. 10 illustrates various positions, in which forces applied by the deck 24 load cause the connector 80 or pin 80 to grip against the sides of the apertures 76, 78, without any knurling, teeth, abrasives, or the like. Simple deflection of metallic parts with the angles of applied force are sufficient to bind the spindle 80 into place. The knob 51 functions primarily as a security mechanism, and to maintain the orientation of the pin 80 essentially perpendicular to the face of the race arm 72.

Various apertures 77 in the race arm 72 secure the arm 72 to the deck 24. By contrast, the apertures 77 in the swing arm 50 serve primarily as pivot points. A single aperture 77 is sufficient for the swing arm 50. Nevertheless, for ease of manufacture in right and left-handed situations, providing two apertures 77 in each swing arm 50 allows inventory of a single part. Similar arrangements for the race arm 72 permit the outer face 71 to always be outward, whether on a right or a left side of the deck.

The ribs 79 may form structural stiffeners for reducing the material required for the arms 72, 50. Ribs may be oriented in any suitable direction for providing the proper degree of stiffness and strength required. Using ribs 79, the arms 72, 50 may be cast, molded, or forged of a suitable material at a lighter net weight, without sacrificing essential strength or stiffness. Since substantial leverage is applied by the deck to the arms 72, 50, aluminum, filled plastic, or steel are suitable materials for providing rigidity, durability, stiffness, and so forth.

Figure 15:
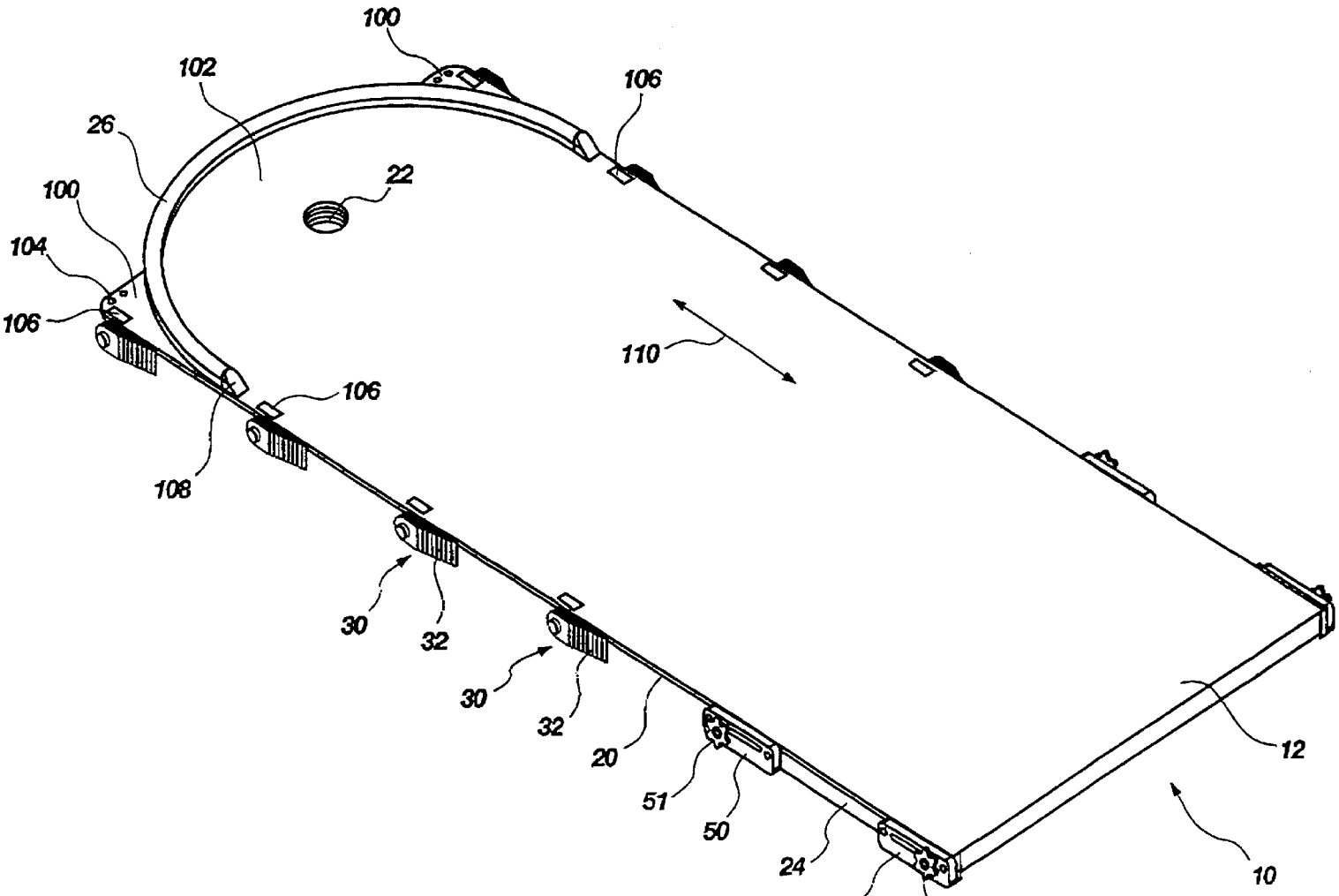
FIG. 15 is a perspective view of an alternative embodiment of a putting green apparatus in accordance with the invention.
Figure 16:
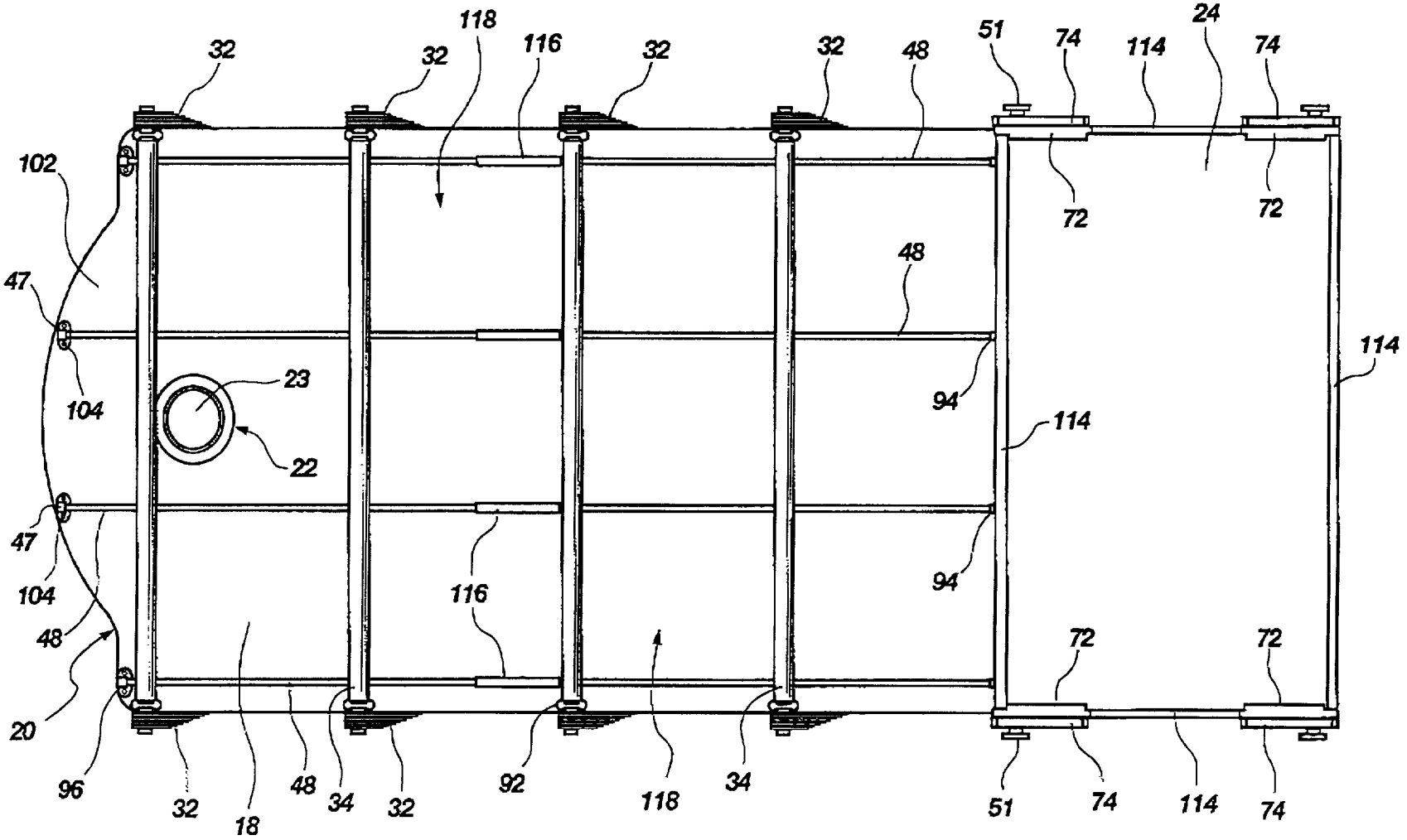
FIG. 16 is a bottom plan view of an alternative embodiment of a stringer (longitudinal rod) and cross-beam system with a light-weight deck suitable for implementation in the apparatus of FIG. 15 in accordance with the invention.

Referring to FIG. 16, in one embodiment of an apparatus in accordance with the invention, a mat 20 may be laid across a surface rendered continuous as to height (position, deflection), change in height (slope or first derivative of deflection), and rate of change of slope (second derivative of deflection) in order to provide smoothly varied contours 40, 42. In the embodiment of FIG. 15, the individual risers 30 or elevator systems 30 may all be virtually identical. Moreover, the individual cross-beams 34 may be identical in cross section and length.

For example, the wing 100 represents an extension of the mat 20 in a substantially rectangular arrangement in order to provide uniform tensioning of the mat 20, and the green layer 14 particularly by the stringers 48. By providing a substantially rectangular region ranging from the green layer 14 over the deck 24 to the underlying cross-beam 34 beyond the cup 22, a fully tensioned mat 20 and fully tensioned green layer 14 provide the balance of continuity, stiffness, and flexibility required to replicate the rolling conditions and contour conditions of a putting green.

The semi-circle 102 or crescent region 102 beyond the cup 22, with respect to the deck 24 supporting a user, is supported, but need not be supported in a fashion identical 5 to the remainder of the surface 12. Accordingly, a properly constructed mat, including a suitable green layer 14, filler 16, and tension layer 18 or other support layer 18, may adequately support the crescent region 102. Balls missing the cup may collect near the backstop 26 and require support from the stringers 48.

In one embodiment, fasteners 104 may anchor pockets 47 to the mat 20. The fasteners 104 may benefit from a durable and substantially rigid construction in order to assure a uniformity and permanence of the tensioning ability of stringers 48 underlying the mat 20. Also, in one embodiment, the stringers 48 and crossbeams 34 may be constructed to provide a single effective surface defined by the uppermost edges thereof. In one presently preferred embodiment, the stringers 48 are actually set into slots 170 (see FIG. 20) formed in the cross-beams 34, in order to provide a fully supported, smooth, single surface for resting the mat 20.

In certain embodiments, label tabs 106 may contain information regarding settings of the feet 32 of the elevators 30 to achieve a set of standard contours. For example, the labels 106 may contain numbered or otherwise sequenced settings which correspond to a predefined contour for each respective elevator 30. Thus, for example, one may read a label 106 to identify a specific setting number. Juxtaposed to the setting number, provided on each individual label 106, a user may move the leg specified by a particular setting number to a deployed position at that respective elevator station 30. Thus, with no complexity or real effort, a user may walk around the apparatus 10, selecting and setting each respective elevator 30 to use the appropiate leg 32 as defined by a label 106 to achieve a particular setting number or countour setting. Thus, contained within the apparatus 10, is a set of standard contours.

Each of the contours 40, 42 may be specifically designed by a golf-course architect. For example, in one embodiment of the apparatus 10 in accordance with the invention, well known and respected architects of golf courses have determined actual contours built into famous golf greens around the world. Accordingly, the apparatus 10 may be adjusted by setting each elevator 30 to the individual leg 32 identified in the respective label 106 to achieve the specific green contour for a known green.

Moreover, the deck 24, by virtue of the adjustable feet 32 may be raised or lowered in order to provide an uphill lie toward the cup 22, a downhill lie toward the cup 22, with a user actually standing on the green layer 14 that will receive the ball. Thus, in contravention to most prior art attempts at golfing greens, an apparatus 10 may be fabricated with so little variation in a transverse direction 28*c* that the ball will not hop or skip after being stroked by the club of a user.

In one embodiment, the label tabs 106 may actually form a portion of the fastening structure for securing the beams 34 under the mat 20. The labels 106 or label tabs 106 may simply be a manifestation on the green layer 14 or the surface 12 of underlying structures penetrating through the mat 20 for securing the beams 34 in place along the mat 20.

The backstop 26 may be formed of a variety of materials. In certain embodiments, an open cell foam has been found suitable for ready deployment, and straightforward stowage. For example, open cell foam that readily expands may be selected. Yet, may collapse under pressure when the mat 20 is separated from its substructure and rolled for storage. The slope 108 or taper 108 is optional, but may provide a termination for suitable support in securing the backstop 26 to the surface 12 of the mat 20 and transmitting without a omer left out to snag. A rounded cross-sectional area in the backstop 26 may provide an improved appearance by eliminating any corners that may or may not properly fold and expand upon storage or deployment.

Tension 110 in the mat 20 is a new and effective mechanism for maintaining a smoothly undulating surface 12, within the smoothness of a suitable golfing green. As a practical matter, the green layer 14 is formed of a material, in certain embodiments, having a selected series of fibers, having colors, stiffnesses, cross-sectional areas, lengths, material properties, anchoring mechanisms, and comparative densities, as well as population fractions, suitable for providing a designed stimp rating. Moreover, the properties of the underlying mat 20 provide the right stiffness and local softness in the overall mat 20 to provide a pre-designed, specified stimp rating for each of the apparatus 10 produced.

The tension 110 is significant in preventing the small discontinuities, bumps, ridges, and other flaws that may exist in a surface 12 in other attempts to provide a suitable surface 12. Moreover, setup is simple, easy and repeatable, not dependent on the "lay of the land" and a flexible "rug." Prior art systems for golfing on an artificial green often cannot match the true stimp rating of a green, because the stimp rating is dependent partly on soils, with the appropriate deflections thereof, as well as on the stiffness and densities, as well as varieties, of the grasses on the green. The tension 110 provides a mechanism for repeatably smoothing and stiffening the green layer 14, while still allowing a degree deflection of the green layer 14 by a golf ball rolling thereon. In one embodiment, the synthetic grasses provided in the green layer 14 actually have a sheen suitable for "reading" a green. Thus, a user can detect, due to the lack of localized uniforming in the green layer 14, each of the breaks or contours 40, 42 in the surface 12 of the green layer 14.

Referring to FIG. 16, while continuing to refer generally to FIGS. 15–21, an apparatus 10 may provide stringers 48 of various lengths. In certain embodiments, the stringers 48 all extend from the deck 24 to positions beyond a most distant cross-beam 34. The stringers 48 cross each, and in some circumstances every, cross-beam 34. Extension of selected stringers 48 beyond the cup 22 can assure that the contours 40, 42 are enforced along the entire distance between the deck 24 and the cup 22.

In certain embodiments, tension in the stringers 48 is provided by connectors 116. In certain embodiments, the connectors 116 may be metal tubes sized to receive stringers 48. Compression springs, having one end enlarged somewhat to provide a substantial frictional contact with the inside of each of the tubes, remain in place but resist intrusion of the stringers 48.

Thus, the connectors 116 actually serve as tensioners 116 providing a pre-determined amount of tension force in the mat 20, in accordance with the net compressive force exerted by each of the springs of the tensioners 116. By properly spacing the stringers 48, each panel 118 of the mat 20 may be substantially identical in size and shape, and loaded exactly as every other panel 118.

In certain embodiments, the underlying tensioning layer 18 (so-called because it may sometimes provide a beam-like flange layer to the filler 16) may be formed of a variety of materials. For example, in certain embodiments, the tension layer 118 may include a fabric, woven or non-woven. In other embodiments, thin plastic sheets having a balance of flexibility and rigidity may be placed across the stringers 48. In other embodiments, corrugated cardboard panels may be placed across the stringers 48. Thus, various versions of a tension layer 18 may be the layer 18, adjacent the filler 16 and opposite the green layer 14.

The swing arms 50 secured by the race arms 72 to the deck 24 may provide a portion of a framing structure for the deck 24. In one embodiment, a rail 114 may be formed of metal, word, or plastic, for providing protection, support, rigidity, fastening stability, and the like for the deck 24. For example, in one embodiment, a rail 114 may be positioned to support the stringers 48 by brackets 94 secured thereto. The brackets 94 may capture each respective stringer against the rail 114. Thus, sections of rail 114 may together form a frame 98 for the deck 24. In certain embodiments, the rail 114 may be formed in a manner to be reversible for various tasks.

The swing arms 50 may be released by the adjusters 51 or knobs 51 for extending below the deck 24. Accordingly, the height adjustment for each of the swing arms 50 may correspond to a range of height adjustment for each of the elevators 30. Accordingly, a user may stand at any relative height between a minimum and maximum value for the deck, while putting toward an upward lie or downward lie toward the cup 22.

Intervening swells, or rises, along the stringers 48 may be provided by adjustment of the feet 32. Similarly, a left-to-right break, or a right-to-left break, may be provided along a contour 40, 42 corresponding to each individual beam 34. Thus, notwithstanding any net gain or loses in altitude between a deck 24 and the cup 22, intervening contours 40, 42 may provide intermediate loss or gain longitudinally 28*a* between the deck 24 and cup 22, or laterally 28*b* from side-to-side along any beam 34.

Figure 17:
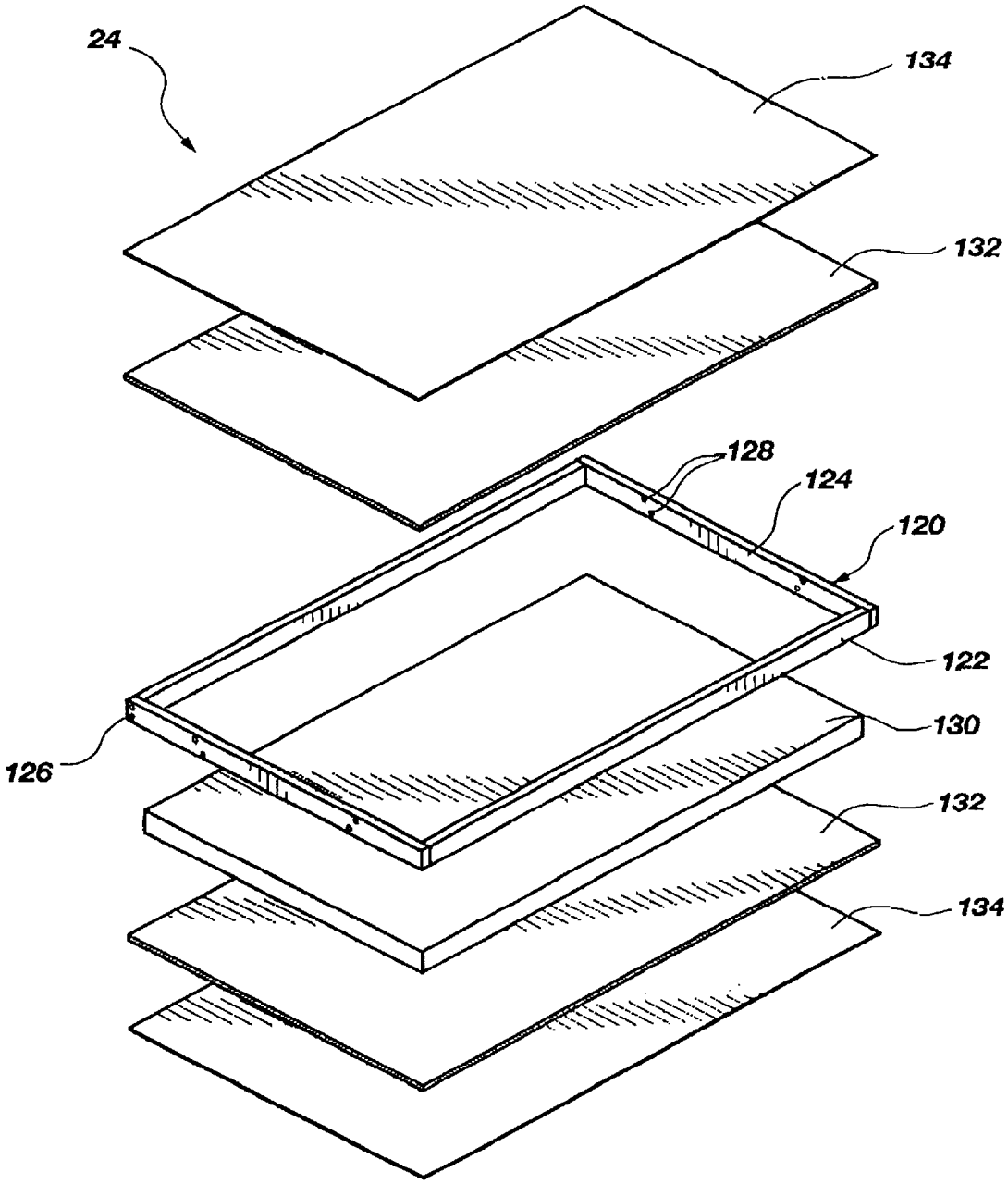
FIG. 17 is a perspective, exploded view of one embodiment of a construction for a light-weight user deck.

Referring to FIG. 17, while continuing to refer generally to FIGS. 1–21, certain embodiments of a deck 24 may include a frame 120, such as may be fabricated from various members 122, 124 of wood, plastic, or the like. In certain embodiments, wood members 122, 124 are secured together by fasteners 126 in a rectangular arrangement. Certain members 124 may receive fasteners, such as anchored nuts 128. Anchored nuts 128 are convenient for securing the race arms 72 of the swing arm 50 on the deck 24.

In certain highly functional embodiments, a foam core 130 of a suitable material, such as an expanded polystyrene plastic, may provide protection against bowing of surrounding decks 132 or sheaths 132. The foam core 130 may protect against collapse in beam bending or columnar buckling between the sheaths 132. Moreover, the foam core 130 may distribute load thereacross. The foam core 130 may not typically support a localized load well. Nevertheless, once a load has been distributed by the sheaths 132, the foam core 130 may provide substantial support while adding minimal weight itself.

The sheaths 132 may be formed of a laminated plywood in order to provide support for tension therethrough. Accordingly, each of the sheaths 132 may distribute a tension and compression load between the pairs of frame members 122 and between the pairs of frame members 124. Moreover, it has been found advantageous to provide a phenolic laminate, or other polymeric laminate as a skin 134 over the sheath 132. Together, the sheath 132 and skin 134 provide a superior support for tension and compression loads across the frame 120, and localized support for the weight of a user.

A deck 24 made in accordance with the embodiment of FIG. 17 experiences a minimal deflection due to a user standing thereon, while providing extremely light weight. A deflection of ⅛ inch or less is typical for a user. This deflection actually corresponds approximately to the deflection a user would experience in standing on an actual green. The green layer 14 overlying the deck 24 provides the sense to a user of being on an actual green, behaving like an actual green.

In certain embodiments, a strip of hook-and-loop material (e.g., velcro™ brand fastener) for supporting tension on the mat 20. The mat 20 may be secured along the deck skin 134 by hook-and-loop fastening material, to support tension provided by the stringers 48.

Figure 18:
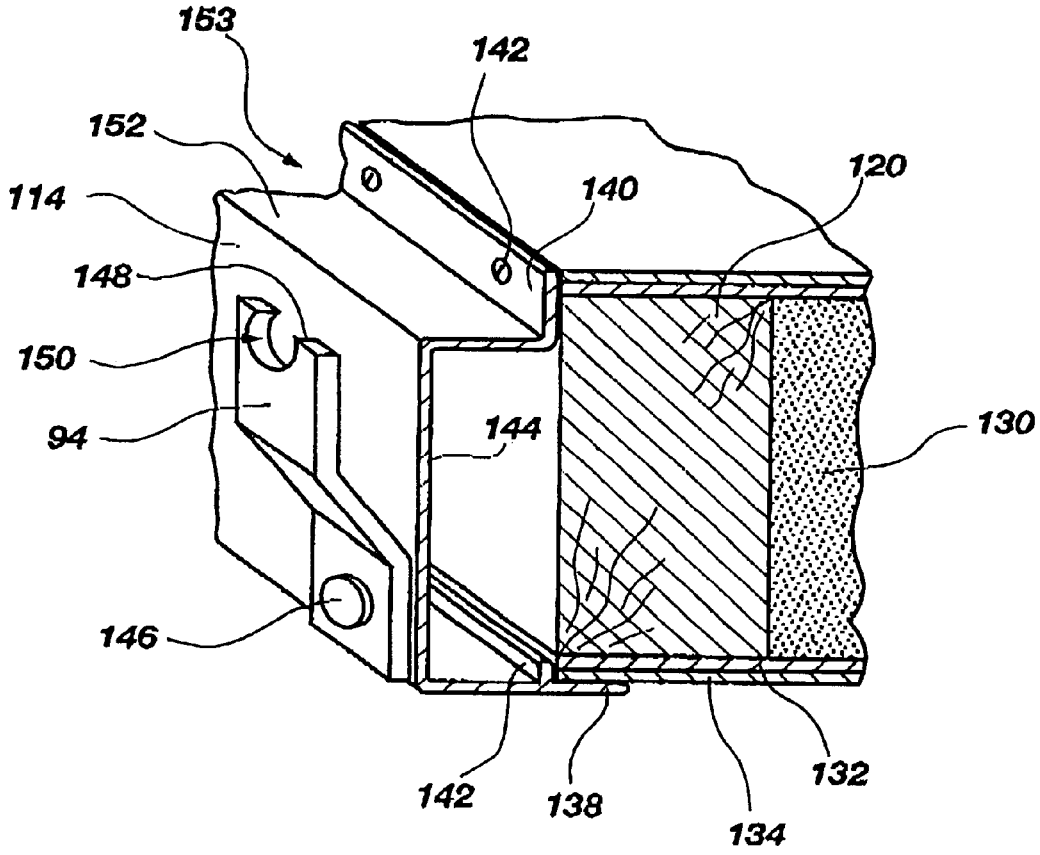
FIG. 18 is a perspective view of one embodiment of a rail system and bracket assembly for supporting the stringers and mat of an apparatus in accordance with the invention.

Referring to FIG. 18, one embodiment of a rail 114 may be an extrusion formed to provide a lip 138 for registering against the deck 24. For example, the skin 134 may fit against the lip 138 while the framing 120 may contact a prong 142. Another portion of the frame 120 may secure to a plate 140 or face 140 of the rail 114 by fasteners 142. Similarly, fasteners 142 may anchor through the lip 138 to the framing 120.

In certain embodiments, the rail 114 may be positioned with the lip 138 on top of the frame 120, providing an offset due to the plate 140. Thus, on the back and two side edges of the frame 120, the plate 140 provides an offset suitable for lifting by fingers of a user underneath the rail 114. In an alternative position, such as at the front edge of the deck 24, a rail 114 may be secured as illustrated in FIG. 18. Thus, the rail 114 provides a web 144 extending substantially across a plane 120 (a height thereof) to support fasteners 146 securing brackets 94 thereto.

The brackets 94 receive stringers into apertures 150. Apertures in the web 144 and/or the deck 24 (frame 120) improve performance of the stringers. The apertures 150 may have open edges 148 so the stringers actually register with the shelf 152 for supporting the mat 20 all in a single surface. The single surface is defined by the top edges of all of the beams 34 and the stringers 48, as well as the top surface of the shelf 152.

The gap or relief 153 provided by the shelf 152, offset by the size of the plate 140, is sized to receive the mat 20, or, more properly, the filler 16, and any optional tension layer 18 that may be therebelow. The green layer 14, by contrast, overlies both the filler resting on the shelf 152, and the deck 24 itself. The smoothness (e.g. continuities) of the green layer 14 may be maintained by providing tolerances of less that 1/16 inch variation in the height of the deck 24, the plate 140, and the upper surface of the filler 16. Accordingly, no skip or hop is experienced by the ball in passing along the green layer 14 on the path between the deck 24 and the cup 22. Minor bumps such as may cause a hop, may thus be eliminated over a wide range of contours in certain embodiments.

Referring to FIG. 19, a pocket 47 may form a way 154 for receiving an end of a stringer 48. In certain embodiments, a pocket 47 may be formed of a fabric. However, in other embodiments, the stiffness of a polymeric or resin-based pocket 47 may provide additional reliability and uniformity in application of tension 110 to the mat 20. For example, the pocket 47 of FIG. 19 may have walls 156 extending beside a stringer 48, for maintaining side-to-side (lateral 28*b*) orientation, for both position and angular orientation. The wall 156 may support both position (deflection) and the first derivative of deflection.

In certain embodiments, tabs 158 may extend on each side of the walls 156. A collar 160 may serve to capture the ends of each stringer 48 in three dimensions. The collar 160 forms a shortened capture mechanism to reduce the amount of end-to-end deflection that must be provided in the stringers 48 in order to be captured within the collar 160. The collar 160 is capped in one presently preferred embodiment. Thus, the collar 160 supports the tension 110, since the stringer 48 cannot penetrate through or pass the collar 160.

Apertures 162 may receive fasteners 104 securing the pockets 47 to the mat 20. The size of the tabs 158, and the fasteners 104 received through the apertures 162 may be designed to further distribute forces in the mat 20, reducing localized distortions. Long tabs 158 may spread the tension load 110 in the mat 20. Orientation of the tabs 158 on the mat 20 may also serve to eliminate kinks and ridges due to nonuniform tensioning 110 between stringers 48 and along the stringers 48.

Referring to FIG. 20, while continuing to refer generally to FIGS. 1–21, a beam 34 and elevator 30 may mount to the mat 20 by means of a fastener 56 or mount 56 having an end that is affixed to the end of the crossbeam 34 and an end 166 that passes through apertures 52 and onto which a cap 58 is affixed, capturing feet 32. Other apertures 168 in posts 169 may receive the labeling tabs 106.

In certain embodiments, the apertures 168 are oriented substantially vertically to intersect with an underside of the mat 20. Meanwhile, slots 170 formed in the beams 34 receive the stringers 48. The bottom edges 172 of the slots 170 tend to align the beams 34 in a circumferential direction with the stringers. Since an end of mount 56 is affixed into the end of crossbeam 34. The apertures 168 are held perpendicular to the mat 20 so as not to deform the mat.

In one presently preferred embodiment, the top edges of the stringers 48 are aligned with the top edges 150 of the slots 170. Accordingly, the top edges 174 and the tops of the stringers 48 form a surface, in a mathematical sense, defining the position of the bottom surface of the mat 20.

A web 176 sufficient to provide structural continuity in the mount 56 may extend between the apertures 168 and surrounding material. Similarly, a stop 177 may limit the insertion of the mount into the crossbeam 34.

In certain embodiments, the label tabs 106 may have additional structure including actual labeling 178 containing messages, on a label piece 180. The piece 180 may be visible on top of surface 12 of the green layer 14, and secured by prongs 182 fitted to the apertures 168. The prongs 182 may penetrate through the mat 20, thus being received and captured in the apertures 168 of the post 169. The prongs 182 may selectively and removably clip into the apertures 168 to render the substructure (beams 34 and stringers 48) completely removable. Like the cup 22, the backstop 26 is easily collapsible, but has excellent mechanical memory for returning to an upright position after storage. Thus, the entire mat 20 may be rolled up and put into a compact, lightweight bundle.

The beam 34 may be secured by the mount 56 to the mat 20 by means of the labeling tab 106. The actual text 178 or label information 178 may include various information. However, in certain embodiments, the labeling 178 actually contains setting values for adjusting the feet 32 in order to achieve a specific contour pattern. Thus, the labeling 178 serves as a template mechanism for identifying a specific set of leg positions defining a contour of the apparatus 10.

Figure 21:
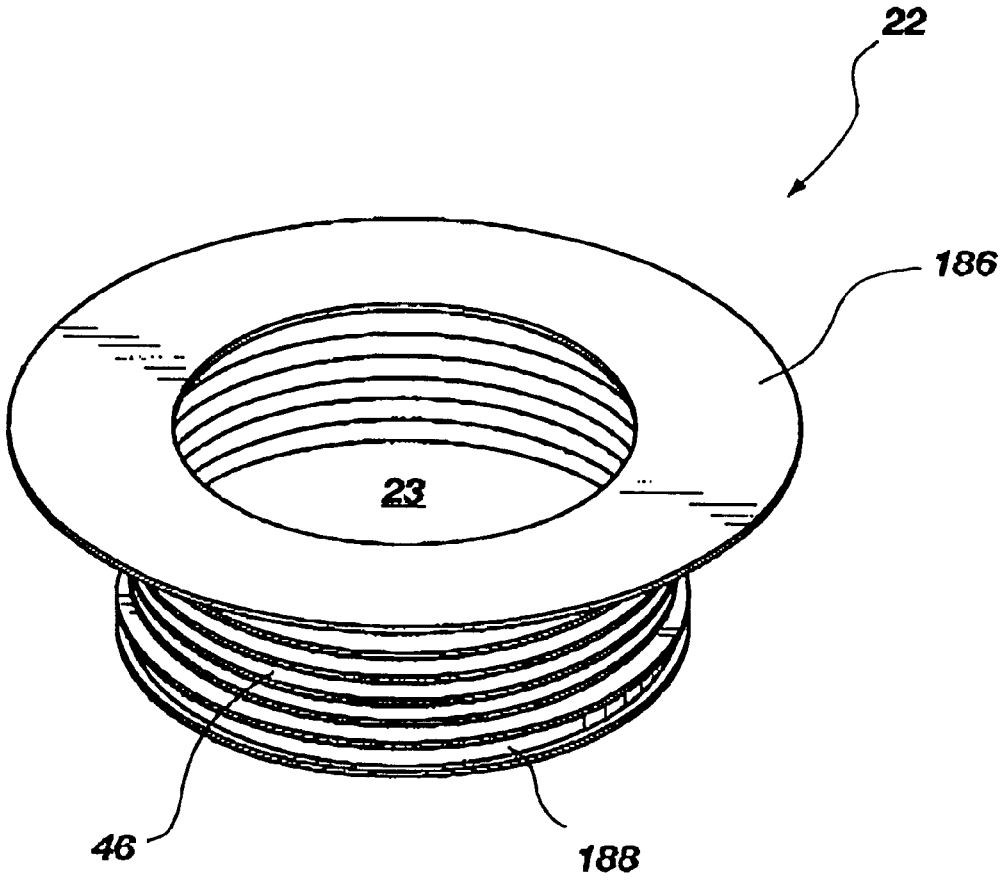
FIG. 21 is a perspective view of one embodiment of a cup for receiving golf balls in an apparatus in accordance with the invention.

Referring to FIG. 21, a cup 22 suitable for inclusion in the apparatus 10, may be formed of a flexible wall to extend a distance below the mat 20. In certain embodiments, a hollow bottom member 23 may provide a suitable feedback to a user. The satisfying thunk of a ball striking the bottom of a cup 22 may be achieved by providing a hollow wooden or plastic bottom 23 secured by a fastener 188 around the bottom end of the flexible wall 46.

Similarly, a suitable fastener (e.g., a label tie, a band, or the like) may secure a top ring 186 to the flexible wall 46. The top ring 186 may fit just below the green layer 14, below the filler layer 16, or the like. If the top ring 186 is formed of a sufficiently thin material, no relief may be required in the filler 16. In an alternative embodiment, a dimension of the top ring 186 may be accommodated by a certain amount of relief provided in the filler layer 16 for receiving the top ring 186. Thus, again, no disturbance to the net height of the green layer 14 need be experienced at the surface 12 by a ball rolling toward the cup 22.

The present invention may be embodied in other specific forms without departing from its structures, methods, or other essential characteristics as broadly described herein and claimed hereinafter. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. An apparatus comprising:

a deck for supporting a user above a supporting surface, the deck having longitudinal, lateral, and transverse directions substantially orthogonal to one another;

a mat securable proximate a first end to the deck and extending away therefrom;

a substructure comprising a lattice of members distributed and extending longitudinally and laterally for supporting the mat above a supporting surface;

the mat further configured to be flexible to roll up to provide mechanical beam bending locally in response to transverse positions of the members of the substructure; and the substructure comprising stringers loaded in compression for providing tension in the mat.

2. The apparatus of claim 1, wherein the mat further comprises:

a base layer for providing localized stress distribution;

a filler layer for increasing the section modulus of the mat, and for locally deflecting transversely a distance corresponding to deflection of a natural putting green in response to the weight of a ball; and a green layer formed of fibers having structural properties designed to selectively deflect in combination with the filler layer in a direction and at a rate corresponding to natural grasses of a natural putting green.

3. The apparatus of claim 1, wherein the mat is configured to replicate a deflection in response to the weight of a ball, the deflection corresponding to deflection of a natural putting green in a transverse direction in response to the weight of a ball.

4. The apparatus of claim 3, wherein the mat is formed to have a plurality of fibers oriented to selectively resist rolling of a golf ball thereacross in a manner designed to provide a stimp meter rating arbitrarily selected.

5. The apparatus of claim 4, wherein the plurality of fibers includes a plurality of types of fibers, each type having mechanical characteristics distinct from the other types.

6. The apparatus of claim 5, wherein each type has an optical characteristic distinct from the optical characteristic of the other types.

7. The apparatus of claim 6, wherein the optical characteristic corresponds to reflectivity of light in a visible bandwidth.

8. The apparatus of claim 1, wherein the deck is configured to have a frame secured to a stress-skin layer for supporting a user.

9. The apparatus of claim 8, wherein the deck is further configured to provide a limited deflection in the transverse direction, the limited deflection corresponding to a deflection of a natural putting green.

10. The apparatus of claim 1, wherein the members of the lattice are substantially evenly distributed in a longitudinal direction.

11. The apparatus of claim 1, wherein the members of the lattice are substantially evenly distributed in a lateral direction.

12. The apparatus of claim 1, wherein the members of the lattice are substantially evenly distributed in a longitudinal direction, and evenly distributed in a lateral direction.

13. The apparatus of claim 1, wherein the deck is configured to be selectively tiltable by a user.

14. The apparatus of claim 13, wherein the deck further comprises lifting members independently positionable to tilt the deck in an arbitrary direction selected by a user.

15. The apparatus of claim 13, wherein the deck further comprises corners having lifting members corresponding thereto for independently positioning the corners each at an altitude arbitrarily selected by a user.

16. The apparatus of claim 13, wherein the deck is positionable substantially arbitrarily, the members further comprise beams and stringers, and the substructure and deck maintain continuity of a first derivative of displacement in the stringers and beams throughout the arbitrary positioning.

17. The apparatus of claim 16, wherein the substructure defines a smoothly continuous surface associated therewith substantially intersecting with a top edge of substantially each of the stringers and beams.

18. The apparatus of claim 1, wherein the substructure comprises stringers loaded axially in compression for providing tension in the mat.

19. The apparatus of claim 13, wherein the deck is positionable to cant laterally, slope longitudinally, and any combination thereof.

20. The apparatus of claim 13, wherein the deck comprises a frame and a skin.

21. The apparatus of claim 20, wherein the deck further comprises a hardened layer over the skin.

22. The apparatus of claim 1, wherein the mat comprises a green layer, and wherein continuity of deflection and a first derivative of deflection are maintained in a green layer by tension of the mat.

23. The apparatus of claim 22 further comprising a fastener securing the green layer to the deck, and wherein the green layer extends from a user position over the deck to a cup as a surface having a substantially continuous first derivative of position.

24. The apparatus of claim 23, wherein substantial continuity reflects an order of magnitude of deflection substantially undetectable during a standard stimp meter test of a golf ball rolling therealong.

25. The apparatus of claim 1, wherein the substructure further comprises:

beams extending laterally;

stringers extending longitudinally between the beams;

legs supporting the substructure; and the legs further configured to be manually positionable by a user for selectively elevating the beams to provide a designed contour of the mat.

26. The apparatus of claim 25, wherein the contour corresponds to and is defined by a straight-line directrix, having two ends, and moved orthogonally to the directrix from a position proximate the deck end to a position proximate a cup end of the mat, the two ends moving exclusively in the transverse direction.

27. The apparatus of claim 1, wherein the substructure is configured to release in response to a user stepping on the apparatus at a location away from the deck.

28. A portable golfing green comprising:

a deck for supporting a user above a supporting surface, the deck having longitudinal, lateral, and transverse directions substantially orthogonal to one another, wherein the deck is configured to be selectively tiltable by a user and comprises a frame and a skin, the skin having a hardened layer thereover;

a mat secured proximate a first end thereof to the deck and extending away therefrom;

a substructure comprising a lattice of members distributed and extending longitudinally and laterally to support the mat; and the mat further configured to be sufficiently flexible to roll up for storage, sufficiently stiff to substantially provide beam support for itself, and sufficiently heavy relative to the stiffness thereof to provide mechanical beam bending locally to substantially directly follow changes in transverse positions of the members of the substructure underlying the mat at locations transversely unsecured thereto.

29. An apparatus comprising:

a deck for supporting a user above a supporting surface, the deck having longitudinal, lateral, and transverse directions substantially orthogonal to one another;

a mat securable proximate a first end thereof to the deck to extend away therefrom;

a substructure comprising a lattice of members distributed and extending in the longitudinal and lateral directions and each configured to directly support the mat thereon;

the mat further configured to be longitudinally and laterally continuous and to self-contour, between lattice members, substantially exclusively under forces provided by its own weight and structure; and the substructure comprising stringers loaded in compression for providing tension in the mat.

* * * * *

UNITED STATES PATENT AND TRADEMARK OFFICE

CERTIFICATE OF CORRECTION

PATENT NO. : 6,338,682 B1
DATED : January 15, 2002
INVENTOR(S) : H. Andrew Torchia et al.

It is certified that error appears in the above-identified patent and that said Letters Patent is hereby corrected as shown below:

Title page,
Item [75], Inventors, after "Frank M. Rowe, Bensenville, Illinois (US)", please add -- Fred P. Smith, Alpine, Utah (US) --.
Item [56], U.S PATENT DOCUMENTS, insert:
-- 5,100,145 March 31, 1992 Kim 273/176H --

Column 1,
Line 18, please delete "one'stability", and insert therefor -- one's ability --.
Line 33, after "produce", please delete -- the --.
Line 39, after "and", please insert -- at the same time, --.
Line 55, please delete "in lateral a.", and insert therefor -- in a lateral --.

Column 2,
Line 39, please delete "laterally", and insert therefor -- (laterally --.

Column 5,
Line 32, please delete "To", and insert therefor -- to --.
Line 33, after "off", please insert -- the deck 24 --.

Column 6,
Line 42, after "provide" please delete "a".
Line 45, after "foot" (first occurrence), please insert -- assembly --.
Line 45, please delete "assembly" (second occurrence).

Column 7,
Line 66, please delete "pin", and insert therefor -- spindle --.

Column 8,
Line 44, please delete "5".

Column 9,
Line 44, please delete "omer", and insert therefor -- corner --.

UNITED STATES PATENT AND TRADEMARK OFFICE

CERTIFICATE OF CORRECTION

PATENT NO. : 6,338,682 B1
DATED : January 15, 2002
INVENTOR(S) : H. Andrew Torchia et al.

It is certified that error appears in the above-identified patent and that said Letters Patent is hereby corrected as shown below:

Column 12,
Line 17, after "filler", please insert therefor -- 16 --.

Column 13,
Line 6, please delete "150", and insert therefor -- 174 --.

Signed and Sealed this

Twenty-sixth Day of August, 2003

JAMES E. ROGAN
*Director of the United States Patent and Trademark Office*